US008443881B2

(12) United States Patent
Thomson et al.

(10) Patent No.: US 8,443,881 B2
(45) Date of Patent: May 21, 2013

(54) EXPANDABLE LINER HANGER AND METHOD OF USE

(75) Inventors: Gordon Thomson, Houston, TX (US); Lev Ring, Houston, TX (US); Varadaraju Gandikota, Houston, TX (US); Paul Andrew Reinhardt, Houston, TX (US); Mike A. Luke, Houston, TX (US); David S. Li, Katy, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 565 days.

(21) Appl. No.: 12/575,977

(22) Filed: Oct. 8, 2009

(65) Prior Publication Data

US 2010/0089591 A1 Apr. 15, 2010

Related U.S. Application Data

(63) Continuation-in-part of application No. 12/250,080, filed on Oct. 13, 2008, now Pat. No. 7,980,302.

(60) Provisional application No. 61/243,994, filed on Sep. 18, 2009.

(51) Int. Cl.
*E21B 43/10* (2006.01)

(52) U.S. Cl.
USPC ..... 166/207; 166/206; 166/382

(58) Field of Classification Search ..... 166/277, 166/207, 206, 382, 244.1; 72/370.01, 370.08
See application file for complete search history.

(56) References Cited

U.S. PATENT DOCUMENTS

| | | | |
|---|---|---|---|
| 3,191,677 | A | 6/1965 | Kinley |
| 3,203,451 | A | 8/1965 | Vincent |
| 3,489,220 | A | 1/1970 | Kinley |
| 3,785,193 | A | 1/1974 | Kinley et al. |
| 5,785,120 | A | 7/1998 | Smalley et al. |
| 5,829,911 | A | 11/1998 | Yokota et al. |
| 6,012,523 | A | 1/2000 | Campbell et al. |
| 6,352,112 | B1 | 3/2002 | Mills |
| 6,415,863 | B1 | 7/2002 | Hudson et al. |

(Continued)

FOREIGN PATENT DOCUMENTS

WO 2007017355 A1 2/2007

OTHER PUBLICATIONS

EP Search Report for Application No. 09172819.6-1266 / 2175101 dated Mar. 16, 2011.

(Continued)

*Primary Examiner* — Brad Harcourt
(74) *Attorney, Agent, or Firm* — Patterson & Sheridan, L.L.P.

(57) ABSTRACT

The present invention generally relates to an expandable liner hanger capable of being expanded into a surrounding casing. In one aspect, an expandable tubular system is provided. The system includes an expandable tubular. The system further includes an expansion swage for expanding the expandable tubular, wherein the expansion swage is deformable from a compliant configuration to a smaller substantially non-compliant configuration. Additionally, the system includes a restriction member disposed on an exterior surface of the expandable tubular, wherein expansion of the expandable tubular in the location of the restriction member deforms the expansion swage from the compliant configuration to the smaller substantially non-compliant configuration. In another aspect, a method of expanding a liner hanger using a cone is provided.

18 Claims, 20 Drawing Sheets

U.S. PATENT DOCUMENTS 6,450,261 B1 9/2002 Baugh
6,457,532 B1 10/2002 Simpson
6,460,615 B1 10/2002 Heijnen
6,557,640 B1 5/2003 Cook et al.
6,622,797 B2 9/2003 Sivley, IV
6,631,769 B2 10/2003 Cook et al.
6,648,075 B2 11/2003 Badrak et al.
6,684,947 B2 2/2004 Cook et al.
6,688,397 B2 2/2004 McClurkin et al.
6,691,777 B2 2/2004 Murray et al.
6,722,427 B2 4/2004 Gano et al.
6,722,441 B2 4/2004 Lauritzen et al.
6,763,893 B2 7/2004 Braddick
6,880,632 B2 4/2005 Tom et al.
7,028,770 B2 4/2006 Smith, Jr. et al.
7,036,582 B2 5/2006 Cook et al.
7,044,218 B2 5/2006 Cook et al.
7,077,213 B2 7/2006 Cook et al.
7,090,005 B2 8/2006 Smith, Jr. et al.
7,108,072 B2 9/2006 Cook et al.
7,111,679 B2 9/2006 Lohbeck et al.
7,114,559 B2 10/2006 Sonnier et al.
7,117,940 B2 10/2006 Campo
7,117,941 B1 10/2006 Gano et al.
7,121,351 B2 10/2006 Luke et al.
7,128,146 B2 10/2006 Baugh et al.
7,140,430 B2 11/2006 Wubben
7,144,243 B2 12/2006 Stephenson et al.
7,191,841 B2 3/2007 Sivley, IV
7,222,669 B2 5/2007 Sonnier et al.
7,243,722 B2 7/2007 Oosterling et al.
7,306,034 B2 * 12/2007 Garcia ..... 166/206
7,322,420 B2 1/2008 Trinder et al.
7,350,563 B2 4/2008 Waddell et al.
7,360,604 B2 4/2008 Lohbeck et al.
7,363,984 B2 4/2008 Brisco et al.
7,377,310 B2 5/2008 Benzie et al.
7,383,888 B2 6/2008 Sivley, IV
7,389,822 B2 6/2008 Lohbeck et al.
7,416,027 B2 8/2008 Ring et al.
7,434,622 B2 10/2008 Luke et al.
7,503,393 B2 3/2009 Shuster et al.
7,546,881 B2 6/2009 Lloyd et al.
7,549,469 B2 6/2009 Garcia
7,549,480 B2 6/2009 Lohbeck
7,559,365 B2 7/2009 Watson et al.
7,571,774 B2 8/2009 Shuster et al.
7,597,140 B2 10/2009 Filippov et al.
7,681,636 B2 3/2010 Roggeband et al.
7,712,522 B2 5/2010 Shuster et al.
7,779,910 B2 8/2010 Watson
7,980,302 B2 7/2011 Ring et al.
2003/0047323 A1 * 3/2003 Jackson et al. ..... 166/380
2003/0155118 A1 8/2003 Sonnier et al.
2004/0168796 A1 9/2004 Baugh et al.
2004/0173361 A1 9/2004 Lohbeck
2004/0231843 A1 11/2004 Simpson
2005/0011650 A1 * 1/2005 Harrall et al. ..... 166/380
2005/0194152 A1 9/2005 Campo
2006/0000617 A1 1/2006 Harrall et al.
2006/0124295 A1 6/2006 Maguire
2006/0130923 A1 6/2006 Lepola et al.
2006/0231249 A1 10/2006 Lohbeck et al.
2007/0012443 A1 1/2007 Luke et al.
2007/0039161 A1 2/2007 Garcia
2007/0205001 A1 9/2007 Shuster et al.
2007/0277971 A1 12/2007 Garcia
2009/0139732 A1 6/2009 Garcia
2009/0229836 A1 9/2009 V
2010/0044030 A1 2/2010 Whiddon et al.

OTHER PUBLICATIONS

Canadian Office Action for Application No. 2,682,426 dated Feb. 3, 2011.

Canadian Office Action dated Jan. 2, 2013, Canadian Patent Application No. 2,682,426.

* cited by examiner

EXPANDABLE LINER HANGER AND METHOD OF USE

CROSS-REFERENCE TO RELATED APPLICATIONS

This application is a continuation-in-part of U.S. patent application Ser. No. 12/250,080, filed Oct. 13, 2008 now U.S. Pat. No. 7,980,302 and this application claims benefit of U.S. provisional patent application Ser. No. 61/243,994, filed Sep. 18, 2009, which are herein incorporated by reference.

BACKGROUND OF THE INVENTION

1. Field of the Invention

Embodiments of the present invention generally relate to apparatus and methods for expanding a tubular in a wellbore. More particularly, embodiments of the present invention relate to an expandable liner hanger.

2. Description of the Related Art

Hydrocarbon wells are typically formed by drilling a borehole from the earth's surface through subterranean formations to a selected depth in order to intersect one or more hydrocarbon bearing formations. A string of casing is used to line the borehole, and an annular area between the casing and the borehole is filled with cement to further support and form the wellbore.

After the initial string of casing is set, the wellbore is drilled to a new depth. An additional string of casing, or liner, is then run into the well to a depth whereby the upper portion of the liner, is overlapping the lower portion of the surface casing. The liner string is then fixed or hung in the wellbore by a liner hanger. The conventional liner hanger includes a slip system to grip the surrounding casing. One problem associated with the slip system of the conventional liner hanger relates to the relative movement of the parts necessary in order to set the liner hanger in a wellbore. Because the slip system requires parts of the liner hanger to be moved in opposing directions, a run-in tool or other mechanical device must necessarily run into the wellbore with the liner hanger to create the movement. Additionally, the slip system takes up valuable annular space in the wellbore.

Expandable tubular technology has been used to fix a liner string in the wellbore. Expansion technology enables a smaller tubular to be run into a larger tubular, and then radially expanded so that a portion of the smaller tubular (a hanger portion, for instance) is in contact with the larger tubular therearound. Tubulars are expanded by the use of a cone-shaped mandrel or by an expander tool with radially extendable members. During expansion of a tubular, the tubular wall is expanded past its elastic limit and gripping formations on the outer surface of the expandable hanger fix the smaller tubular in the larger diameter tubular.

While expanding tubulars in a wellbore offers obvious advantages, there are problems associated with using the technology to create a hanger through the expansion of one tubular into a surrounding casing. One problem is that the internal diameter of the casing may vary within currently accepted tolerances. For instance, American Petroleum Institute (API) tolerances permit the internal diameter of casing to vary by 0.25" more or less, depending on the size of the casing. This variation in the internal diameter of the casing can cause a fixed diameter cone to become stuck in the wellbore, if the variation is on the low side. Conversely, this variation in the internal diameter of casing can also cause an inadequate expansion of the tubular in the casing if the variation is on the high side. The result is an inadequate coupling between the tubular and the casing.

Thus, there exists a need for an improved expandable liner hanger that accounts for variations in the internal diameter of casing.

SUMMARY OF THE INVENTION

The present invention generally relates to an expandable liner hanger capable of being expanded into a surrounding casing. In one aspect, an expandable tubular system is provided. The system includes an expandable tubular. The system further includes an expansion swage for expanding the expandable tubular, wherein the expansion swage is deformable from a compliant configuration to a smaller substantially non-compliant configuration. Additionally, the system includes a restriction member disposed on an exterior surface of the expandable tubular, wherein expansion of the expandable tubular in the location of the restriction member deforms the expansion swage from the compliant configuration to the smaller substantially non-compliant configuration.

In another aspect, a method of expanding a liner hanger using a cone is provided. The method includes the step of expanding a portion of the liner hanger into contact with a surrounding tubular by utilizing the cone in a first configuration. The method further includes the step of expanding a setting ring disposed around the liner hanger into contact with the surrounding tubular, which causes the cone to change to a second smaller configuration. Additionally, the method includes the step of expanding another portion of the liner hanger into contact with the surrounding tubular by utilizing the cone in the second smaller configuration.

In a further aspect, a liner hanger for use in a wellbore is provided. The liner hanger includes a tubular body having a plurality of gripping inserts circumferentially disposed around the body, each insert housed in a corresponding aperture formed in a wall of the body. The liner hanger further includes a plurality of grooves circumferentially disposed around the body, the grooves formed parallel to a longitudinal axis of the body, whereby each insert is disposed between a pair of grooves.

In yet a further aspect, a method of selecting a ring member for use with an expandable tubular having a seal member is provided. The ring member is configured to reshape a swage assembly upon expansion of the ring member into contact with a surrounding tubular. The method includes the step of establishing a target seal compression of the seal member upon expansion of the expandable tubular. The method further includes the step of determining a first seal compression of the seal member based upon expanding the tubular in a surrounding tubular having a maximum inner diameter. The method also includes the step of determining a second seal compression of the seal member based upon expanding the tubular in a surrounding tubular having a minimum inner diameter. Additionally, the method includes the step of setting a height of the ring member to obtain the target seal compression for the seal member based upon the first seal compression and second seal compression.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention generally relate to an expandable liner hanger capable of being expanded into a surrounding casing. To better understand the aspects of the present invention and the methods of use thereof, reference is hereafter made to the accompanying drawings.

Figure 1:
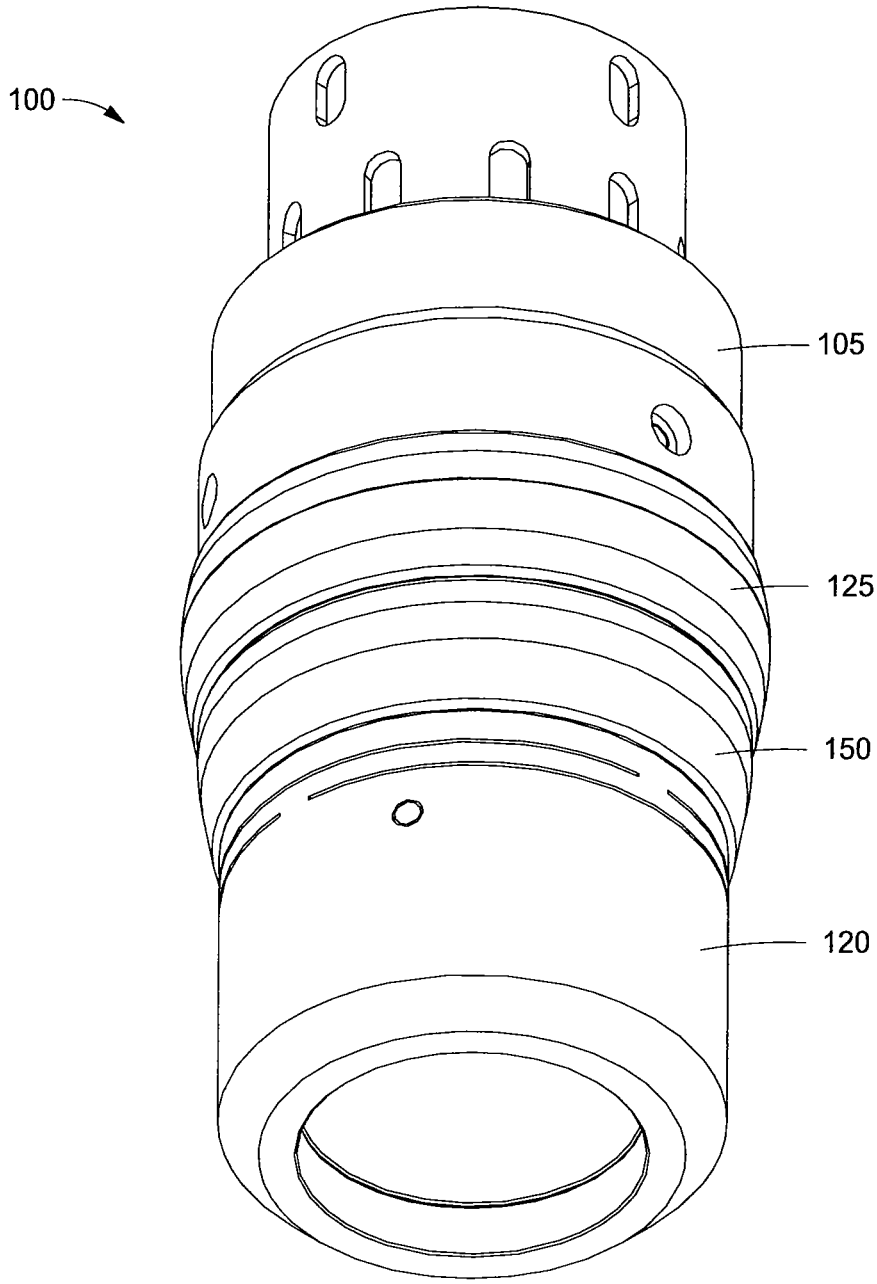
FIG. 1 is an isometric view of a swage assembly according to one embodiment of the invention.

FIG. 1 is an isometric view of a swage assembly 100 according to one embodiment of the invention. The swage assembly 100 is configured to expand a tubular in the wellbore, such as a liner hanger. The swage assembly 100 generally includes a substantially solid deformable cone 125. As will be described herein, the swage assembly 100 may be moved from a first configuration where the swage assembly 100 has a substantially compliant manner to a second configuration where the swage assembly 100 has a substantially non-compliant manner.

Figure 2:
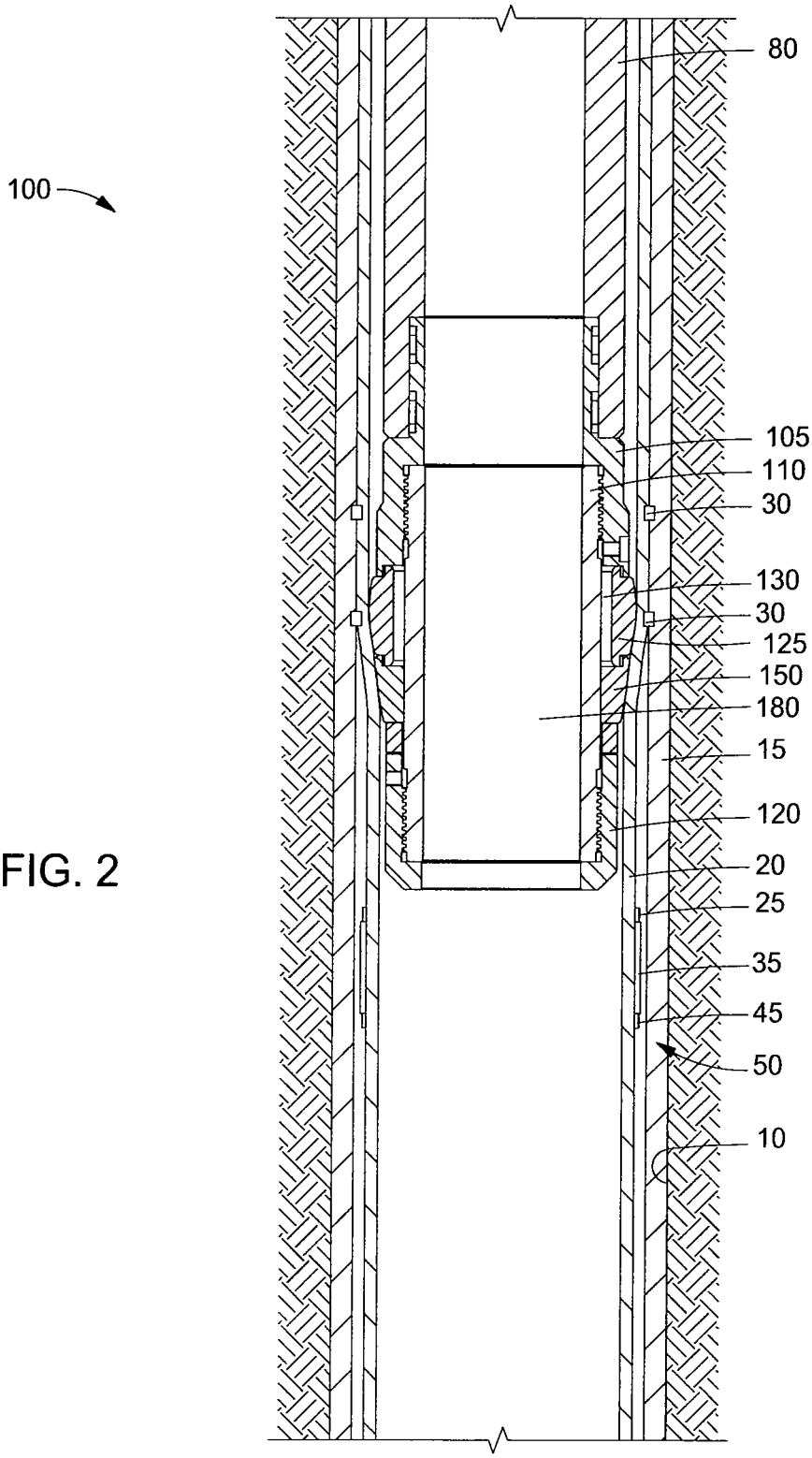
FIG. 2 is a view illustrating the swage assembly in a first shape as the swage assembly expands a tubular in a wellbore.

FIG. 2 is a view illustrating the swage assembly 100 expanding a tubular 20 in a wellbore 10. As shown, the tubular 20 is disposed in a casing 15 which lines the wellbore 10. In some embodiments, cement may be disposed in between the wellbore 10 and the casing 15. The tubular 20 may be located in the wellbore 10 by a running tool (not shown). An example of a running tool is a Weatherford® HNG Hydraulic-Release Running Tool. The running tool may include a selectively actuated engagement member (such as a collet) configured to engage and hold a portion of the tubular 20 while the swage assembly 100 expands a section of the tubular 20 into the casing 15 and then release the tubular 20 after completion of the expansion operation. The running tool may also include a piston arrangement that is configured to move the swage assembly 100 through the tubular 20 during the expansion operation. Activation of the piston arrangement to move the swage assembly 100 may be accomplished by first closing off a lower portion of running tool (e.g., by landing a ball in a seat or by closing a valve, etc.), and then applying hydraulic pressure through the workstring attached to the running tool. In one embodiment, the tubular 20 and the swage assembly 100 are positioned in the wellbore 10 at the same time. In another embodiment, the tubular 20 and the swage assembly 100 are positioned in the wellbore 10 separately.

The tubular 20 may include a restriction to expansion that may cause the swage assembly 100 to move from the first configuration to the second configuration. It should be noted if the force required to expand the tubular 20 proximate the restriction is greater than the force required to urge the material of deformable cone 125 past its yield point, then the material of the deformable cone 125 will plastically deform, and the swage assembly 100 will move from the first configuration to the second configuration. In one embodiment, the restriction may be a protrusion on an outer surface of the tubular 20 such as a plurality of gripping inserts 30. In another embodiment, the restriction may be a seal assembly 150 comprising a seal member 35, such as an elastomer, a first ring member 25 and a second ring member 45. In a further embodiment, the restriction may be a setting ring member disposed around the tubular 20, such as setting rings 825 and 1025 in FIGS. 19 and 25, respectively. The setting ring may be at least partially deformable. The material for the setting ring may be an elastomer, a composite or a soft metal relative to the tubular 20. In yet a further embodiment, the restriction may be due to irregularities (e.g., non-circular cross-section) in the tubular 20 and/or the casing 15. It should be noted the restriction is not limited to these examples but rather the restriction may be any type of restriction. Further, the restriction may be on the tubular 20, on the casing 15 or in the annulus between the tubular 20 and the casing 15.

As illustrated in FIG. 2, the swage assembly 100 includes a first sleeve 120 attached to the body 110. The first sleeve 120 is used to guide the swage assembly 100 through the tubular 20. The first sleeve 120 has an opening at a lower end to allow fluid or other material to be pumped through a bore 180 of the swage assembly 100. In another embodiment, the sleeve 120 is attached to a workstring to allow the swage assembly 100 to be urged upward in the tubular 20 during a bottom-top expansion operation.

The swage assembly 100 also includes a second sleeve 105. The second sleeve 105 is used to connect the swage assembly 100 to a workstring 80, which is used to position the swage assembly 100 in the wellbore 10. In one embodiment, the tubular 20 and the swage assembly 100 are positioned in the wellbore 10 at the same time via the workstring 80. In another embodiment, the tubular 20 and the swage assembly 100 are positioned in the wellbore separately. The second sleeve 105 is connected to a body 110 of the swage assembly 100. Generally, the body 110 is used to interconnect all the components of the swage assembly 100.

The solid deformable cone 125 is disposed in a cavity 130 defined by the second sleeve 105, a body 110 and a non-deformable cone 150. The cross-section of the solid deformable cone 125 is configured to allow the solid deformable cone 125 to move within the cavity 130. For instance, when the swage assembly 100 is in the first configuration, the solid deformable cone 125 is generally movable within the cavity 130 as the swage assembly 100 is urged through the tubular 20. When the swage assembly 100 is in the second configuration, the solid deformable cone 125 generally remains substantially stationary within the cavity 130 as the swage assembly 100 is urged through the tubular 20. The position of the solid deformable cone 125 in the cavity 130 relates to the shape of the swage assembly 100. Additionally, after the swage assembly 100 is removed from the wellbore 10, the solid deformable cone 125 may be removed and replaced with another solid deformable cone 125 if necessary.

As shown in FIG. 2, the swage assembly 100 also includes the non-deformable cone 150. It is to be noted that the non-deformable cone 150 may be an optional component. Generally, the non-deformable cone 150 may be the portion of the swage assembly 100 that initially contacts and expands the tubular 20 as the swage assembly 100 is urged through the tubular 20. The non-deformable cone 150 is typically made from a material that has a higher yield strength than a material of the solid deformable cone 125. For instance, the non-deformable cone 150 may be made from a material having 150 ksi, while the solid deformable cone 125 may be made from a material having 135 ksi. The difference in the yield strength of the material between the non-deformable cone 150 and the solid deformable cone 125 allows the solid deformable cone 125 to collapse inward as a certain radial force is applied to the swage assembly 100. The selection of the material for the solid deformable cone 125 directly relates to the amount of compliancy in the swage assembly 100. Further, the material may be selected depending on the expansion application. For instance, a material with a high yield strength may be selected when the expansion application requires a small range compliancy, or a material with a low yield strength may be selected when the expansion application requires a wider range of compliancy. The amount of compliancy allows the swage assembly 100 to compensate for variations in the internal diameter of the casing 15. In a further embodiment, the non-deformable cone 150 and the solid deformable cone 125 may be made from a similar material with varying cross-sections. In this embodiment, the non-deformable cone 150 would have a considerably thicker cross-section (or sectional collapse resistance) as compared to the cross-section of the solid deformable cone 125. The difference in the thickness of the cross-section allows the solid deformable cone 125 to collapse inward as a certain radial force is applied to the swage assembly 100. The selection of the thickness for the solid deformable cone 125 directly relates to the amount of compliancy in the swage assembly 100.

Figure 5:
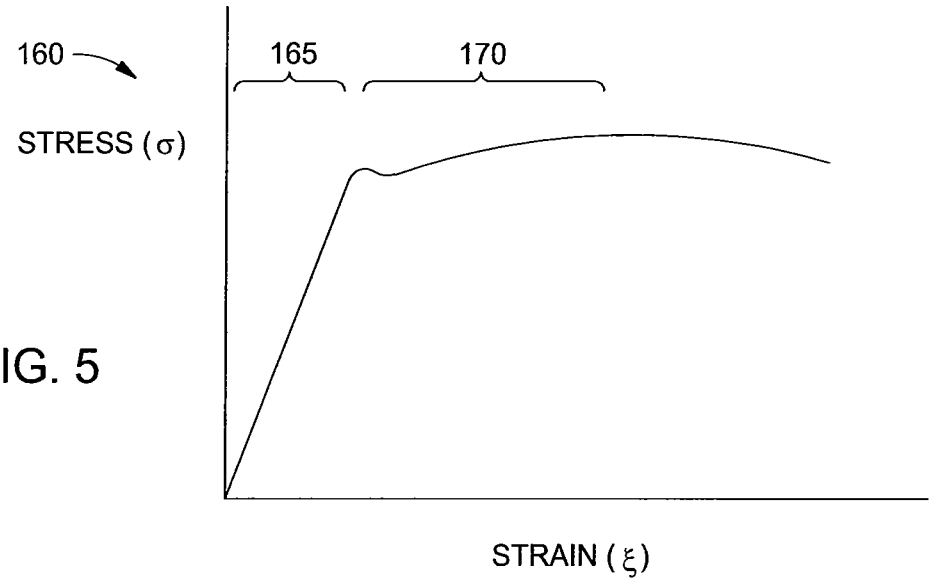
FIG. 5 is a graph illustrating a stress-strain curve.

In FIG. 2, the swage assembly 100 is in the first configuration as the swage assembly 100 expands a portion of the tubular 20 into contact with the surrounding casing 15. In the first configuration, the solid deformable cone 125 may elastically deform and then spring back to its original shape as the solid deformable cone 125 contacts the tubular 20. For instance, as the solid deformable cone 125 contacts the inner diameter of the tubular 20 proximate a restriction (e.g., setting rings), the solid deformable cone 125 may contract (or move radially inward) into the cavity 130 and then expand (or move radially outward) from the cavity 130 as the swage assembly 100 continues to move and expand the tubular 20. In other words, the solid deformable cone 125 may contract from its original shape and then expand back to its original shape as the material of the solid deformable cone 125 moves in an elastic region 165 below a yield point as illustrated on a graph 160 of FIG. 5. In this configuration, the force acting on the inner diameter of the tubular 20 may vary depending on the position of the solid deformable cone 125 in the cavity 130.

Figure 3:
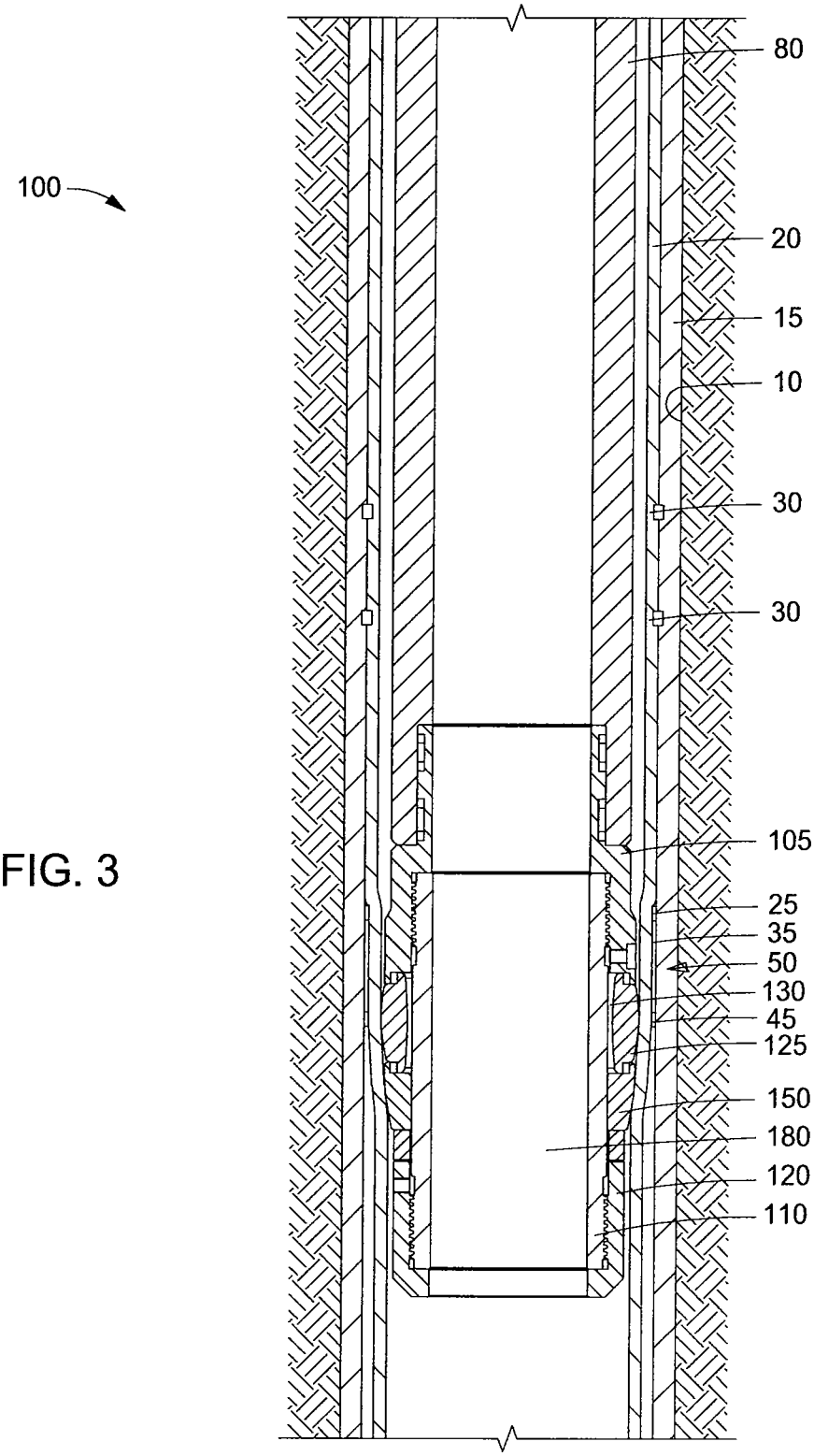
FIG. 3 is a view illustrating the swage assembly in a second shape as the swage assembly expands the tubular.

FIG. 3 is a view illustrating the swage assembly 100 in the second configuration as the swage assembly 100 expands a portion of the tubular 20 into contact with the surrounding casing 15. In the second configuration, the solid deformable cone 125 has been plastically deformed and therefore remains substantially stationary within the cavity 130 as the solid deformable cone 125 contacts the tubular 20. To move the swage assembly 100 from the first configuration to the second configuration, the swage assembly 100 expands a portion of the tubular 20 that includes a cross-section (e.g., restriction) that is configured to cause the material of the solid deformable cone 125 to pass a yield point and become plastically deformed. In one embodiment, the restriction in the tubular may be used as a trigger point which causes the swage assembly 100 to move from the first configuration (FIG. 2) to the second configuration (FIG. 3). The expansion of the restriction by the swage assembly 100 causes the material of the solid deformable cone 125 to pass the yield point into a plastic region 170 as shown on a graph 160 in FIG. 5. This causes the solid deformable cone 125 to remain in a contracted configuration relative to its original shape. Referring back to FIG. 3, the solid deformable cone 125 in the second configuration causes the swage assembly 100 to have a reduced diameter shape.

Figure 4:
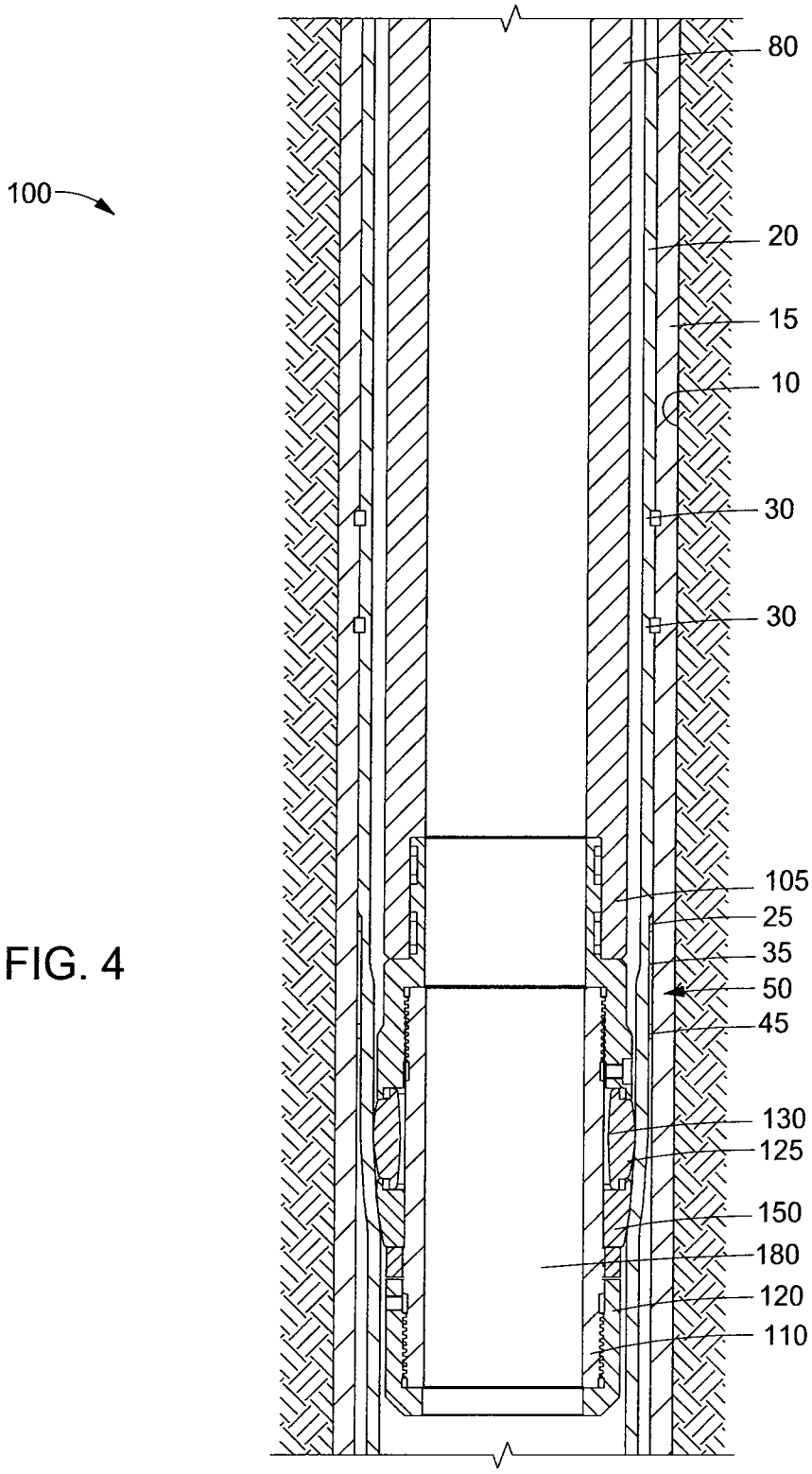
FIG. 4 is a view illustrating the swage assembly expanding another portion of the tubular.

FIG. 4 is a view illustrating the swage assembly 100 expanding another portion of the tubular 20. When the swage assembly 100 is in the second configuration, the swage assembly 100 may still be used to further expand the tubular 20 into contact with the surrounding casing 15. In this configuration, the force from the solid deformable cone 125 acting on the inner diameter of the tubular 20 is substantially constant. Further, due to an irregular expansion of the tubular 20, a portion of the deformable cone 125 may plastically deform, while another portion of the deformable cone 125 may elastically deform.

In addition to the first configuration and the second configuration, the swage assembly 100 may have a third configuration after the material in the solid deformable cone 125 has plastically deformed. Generally, after the solid deformable cone 125 has plastically deformed, the solid deformable cone 125 still retains a limited range of compliancy. In the third configuration, the material of the deformable cone 125 moves in the plastic region 170 of the graph 160 such that the deformable cone 125 moves between a first diameter (e.g., original outer diameter) and a second smaller diameter. In a similar manner, the swage assembly 100 may have a forth, a fifth, a sixth or more configurations as the material of the deformable cone 125 continues to move in the plastic region 170 of the graph 160 of FIG. 5, wherein each further configuration causes the deformable cone 125 to become less and less compliant. In other words, the deformable cone 125 may be plastically deformed more than once. The ability of the deformable cone 125 to change configuration multiple times is advantageous when the tubular 20 includes a plurality of setting rings and seal members separated by longer distances along the length of the tubular 20. In this arrangement, the deformable cone 125 may change from a first configuration to a second configuration upon expanding a first setting ring, and then may further change from the second configuration to a third configuration upon expanding a second setting ring, and then may further change from the third configuration to a fourth configuration upon expanding a third setting ring, and so on. The changing of configuration of the deformable cone 125 multiple times allows the seal member disposed adjacent each setting ring to have a controlled amount of seal compression upon expansion of the respective seal member.

In operation, the swage assembly 100 expands the tubular 20 into contact with the surrounding casing 15 by exerting a force on the inner diameter of the tubular 20. The force necessary to expand the tubular 20 may vary during the expansion operation. For instance, if there is a restriction in the wellbore 10, then the force required to expand the tubular 20 proximate the restriction will be greater than if there is no restriction. It should be noted that if the force required to expand the tubular 20 proximate the restriction is less than the force required to urge the material of deformable cone 125 past its yield point, then the material of the deformable cone 125 may elastically deform, and the swage assembly 100 will expand the tubular 20 in the first configuration. However, if the force required to expand the tubular 20 proximate the restriction is greater than the force required to urge the material of deformable cone 125 past its yield point then the material of the deformable cone 125 may plastically deform and the swage assembly 100 will move from the first configuration to the second configuration. This aspect of the swage assembly 100 allows the swage assembly 100 to change configuration rather than becoming stuck in the tubular 20 or causing damage to other components in the wellbore 10, such the tubular 20, the workstring 80 or the tubular connections. After the swage assembly 100 changes configurations, the swage assembly 100 continues to expand the tubular 20.

Figure 6:
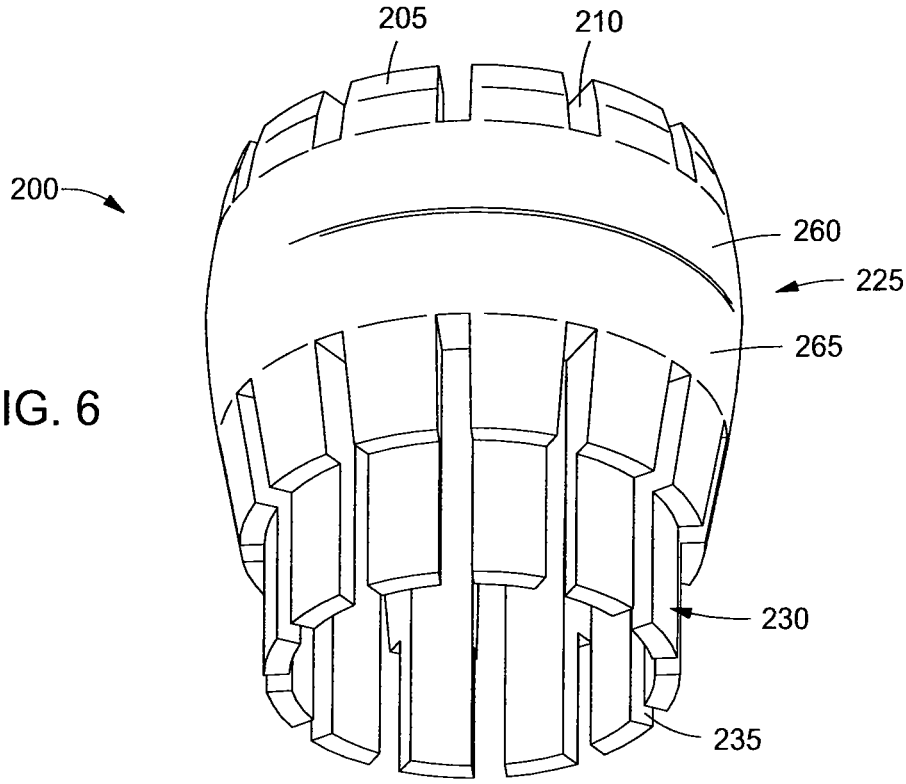
FIG. 6 is an isometric view of a swage assembly according to one embodiment of the invention.

FIG. 6 is an isometric view of a swage assembly 200 according to one embodiment of the invention. The swage assembly 200 is configured to expand a tubular in the wellbore. The swage assembly 200 generally includes a plurality of upper fingers 205 and slots 210, a deformable cone portion 225 and a plurality of lower fingers 230 and slots 235. The swage assembly 200 may be moved from a compliant configuration having a first shape to a substantially non-compliant configuration having a second shape.

As shown in FIG. 6, the deformable cone portion 225 is disposed between the upper fingers 205 and the lower fingers 230. The deformable cone portion 225 may include a first section 260 and a second section 265. Generally, the first section 260 is the part of the swage assembly 200 that initially contacts and expands the tubular as the swage assembly 200 is urged through the tubular. In the embodiment illustrated, the entire deformable cone portion 225 is made from the same material. The selection of the material for the deformable cone portion 225 directly relates to the amount of compliancy in the swage assembly 200. The material may be selected depending on the expansion application. For instance, a material with a higher yield strength may be selected when the expansion application requires a small range compliancy in the swage assembly 200 or a material with a lower yield strength may be selected when the expansion application requires a wider range of compliancy in the swage assembly 200.

In another embodiment, a portion of the deformable cone portion 225 may be made from a first material, and another portion of the deformable cone portion 225 is made from a second material. For instance, the first section 260 of the deformable cone portion 225 may be made from a material that has a higher yield strength than a material of the second section 265. The difference in the material yield strength between the first section 260 and the second section 265 allows the second section 265 to collapse radially inward upon application of a certain radial force to the swage assembly 200. In a further embodiment, the deformable cone portion 225 may have layers of different material, wherein each layer has a different yield strength.

In the compliant configuration, the deformable cone portion 225 elastically deforms and moves between an original shape and a collapsed shape as the swage assembly 200 is urged through the tubular. For instance, as the deformable cone portion 225 contacts the inner diameter of the tubular proximate a restriction, the deformable cone portion 225 may contract from the original shape (or move radially inward) and then return to the original shape (or move radially outward) as the swage assembly 200 moves through the tubular. As the deformable cone portion 225 moves between the original shape and the contracted shape, the fingers 205, 230 flex and reduce the size of the slots 210, 235. The swage assembly 200 will remain in the compliant configuration while the material of the deformable cone portion 225 is below its yield point (e.g., elastic region). In this configuration, the force acting on the inner diameter of the tubular may vary due to the compliant nature of the deformable cone portion 225.

In the non-compliant configuration, the deformable cone portion 225 has been plastically deformed and remains substantially rigid as the swage assembly 200 is urged through the tubular. To move the swage assembly 200 from the compliant configuration to the non-compliant configuration, the swage assembly 200 expands a portion of the tubular that includes a cross-section that is configured to cause the material of the deformable cone 225 to pass its yield point. After the material of the deformable cone portion 225 passes its yield point, the deformable cone portion 225 will remain in a shape or size (e.g., collapsed or crushed shape) that is different from its original shape. When the swage assembly 200 is in the substantially non-compliant configuration, the swage assembly 200 may still be used to further expand the tubular into contact with the surrounding casing. In this configuration, the force acting on the inner diameter of the tubular is substantially constant due to the non-compliant nature of the deformable cone portion 225.

Figure 7:
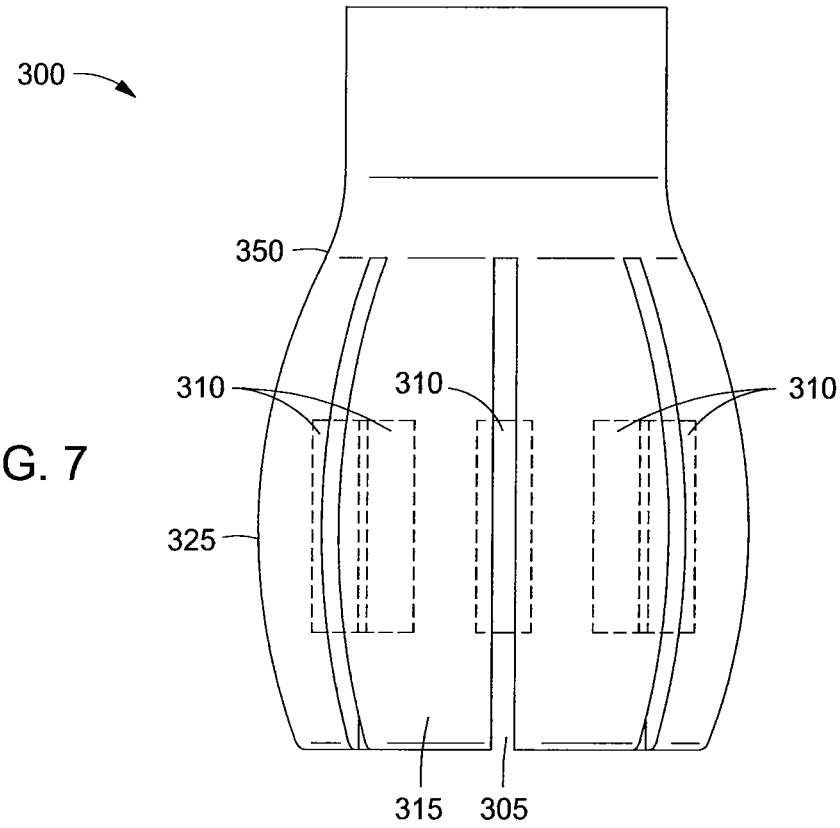
FIG. 7 is a view illustrating a swage assembly according to one embodiment of the invention.
Figure 8:
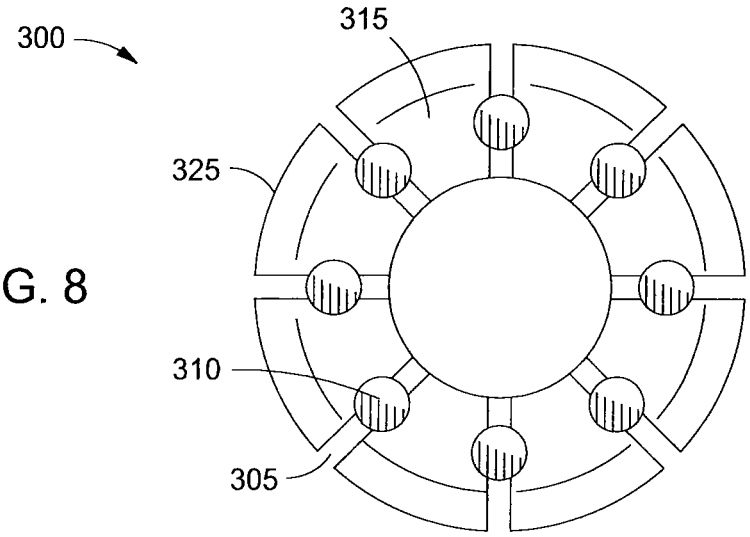
FIG. 8 is a cross-sectional view of the swage assembly in FIG. 7.

FIG. 7 and FIG. 8 are views of a swage assembly 300 according to one embodiment of the invention. The swage assembly 300 is configured to expand a tubular in the wellbore. The swage assembly 300 generally includes a cone portion 325, a plurality of fingers 315 and a plurality of inserts 310 in slots 305 in between the fingers 315. The swage assembly 300 may be moved from a compliant configuration having a first shape to a substantially non-compliant configuration having a second shape.

In the compliant configuration, the cone portion 325 elastically deforms and moves between an original shape and a collapsed shape as the swage assembly 300 is urged through the tubular. For instance, as the cone portion 325 contacts the inner diameter of the tubular proximate the inserts on the tubular (see FIG. 2), the cone portion 325 may move radially inward and then move radially outward (or return to its original shape) as the swage assembly 300 moves through the tubular. As the cone portion 325 moves between the original shape and the contracted shape, the fingers 315 flex, which causes the inserts 310 in the slots 305 to react. The inserts 310 are sized, and the material of the inserts 310 is selected to provide an elastic response when the applied load is below the yield point of the material and to provide a plastic response when the applied load is above the yield point of the material. In essence, the cone portion 325 will act in a compliant manner, while the material of the inserts 310 is below its yield point (e.g., elastic region). Further, in this configuration, the force acting on the inner diameter of the tubular may vary due to the compliant nature of the cone portion 325. Additionally, it should be noted that the inserts 310 are configured to bias the fingers 315 radially outward to allow the cone portion 325 to return to its original shape as the swage assembly 300 moves through the tubular.

The selection of the material for the inserts 310 directly relates to the amount of compliancy in the swage assembly 300. The material may be selected depending on the expansion application. For instance, a material with a higher yield strength may be selected when the expansion application requires a small range compliancy, or a material with a lower yield strength may be selected when the expansion application requires a wider range of compliancy. Additionally, the inserts 310 may be secured in the slots 305 by brazing, gluing or any other means known in the art.

In the non-compliant configuration, the cone portion 325 has been plastically deformed and remains substantially rigid as the swage assembly 300 is urged through the tubular. To move the swage assembly 300 from the compliant configuration to the non-compliant configuration, the swage assembly 300 expands a portion of the tubular that includes a cross-section that is configured to cause the material of the inserts 310 to pass its yield point. After the material of the inserts 310 passes the yield point, the cone portion 325 will remain in a configuration that is different (e.g., collapsed shape) from its original shape. When the swage assembly 300 is in the substantially non-compliant configuration, the swage assembly 300 may still be used to further expand the tubular into contact with the surrounding casing. In this configuration, the force from the cone portion 325 acting on the inner diameter of the tubular is substantially constant. In another embodiment, the fingers 315 may separate from the inserts 310 along a bonded portion when the material of the inserts 310 passes its yield point, thereby causing the fingers 315 to have a greater range of movement or flexibility. The flexibility of the fingers 315 allows the swage assembly 300 to become more compliant rather than less compliant when the material of inserts 310 is plastically deformed.

Figure 10:
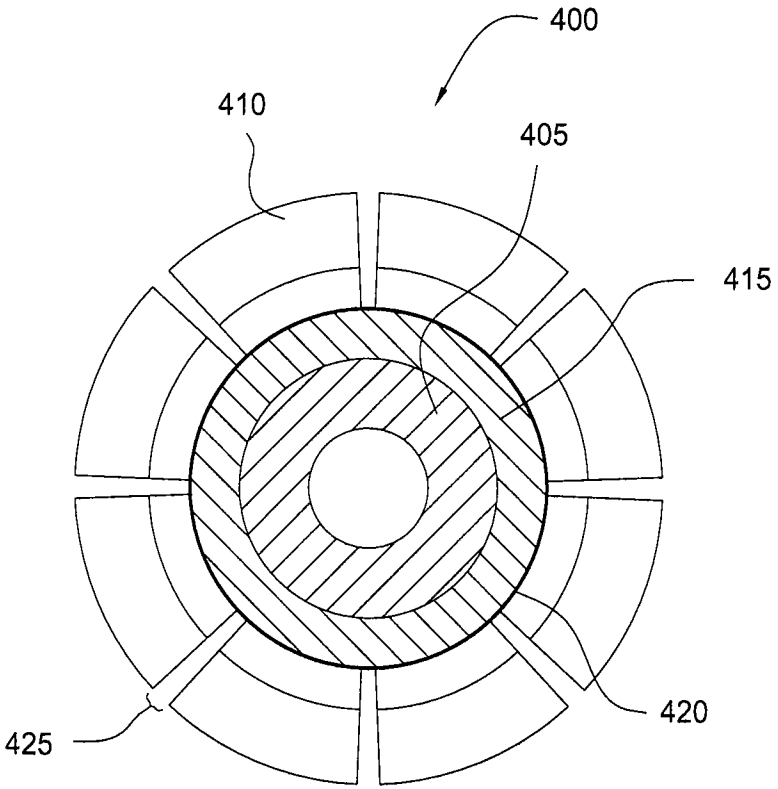
FIG. 10 is a sectional view of the swage assembly in FIG. 9.
Figure 9:
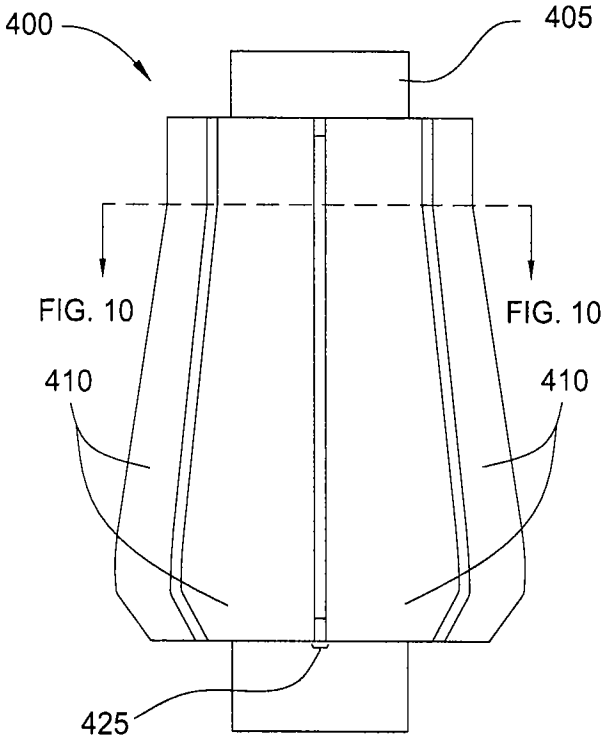
FIG. 9 is a view illustrating a swage assembly according to one embodiment of the invention.

FIG. 9 and FIG. 10 are views of a swage assembly 400 according to one embodiment of the invention. The swage assembly 400 is configured to expand a tubular in the wellbore. The swage assembly 400 generally includes a mandrel 405, a plurality of cone segments 410 and a resilient member 415. As discussed herein, the configuration (e.g., outer diameter) of the swage assembly 400 adjusts as the swage assembly 400 moves through the tubular.

As shown in FIGS. 9 and 10, the resilient member 415 is disposed around the mandrel 405. The resilient member 415 may be bonded to the mandrel 405 by any means known in the art. The resilient member 415 is configured to act as a compliant member. Generally, the resilient member 415 is selected based on compliance range limits. For instance, a rigid material may be selected when the expansion application requires a small range compliancy or a flexible material may be selected when the expansion application requires a wider range of compliancy. As also shown in FIGS. 9 and 10, the plurality of cone segments 410 is disposed on the resilient member 415. Each pair of cone segments 410 is separated by a gap 425.

The swage assembly 400 moves between a first shape (e.g., an original shape) and a second shape (e.g., a contracted shape) as the swage assembly 400 is urged through the tubular. For instance, as the swage assembly 400 contacts an inner diameter of the tubular proximate a restriction, the swage assembly 400 may contract from the original shape (or move radially inward) and then return to the original shape (or move radially outward) as the swage assembly 400 continues to move through the tubular past the restriction. As the swage assembly 400 moves between the original shape and the contracted shape, the cone segments 410 flex inward to reduce the gap 425 which subsequently adjusts the size of the swage assembly 400. The force acting on the inner diameter of the tubular may vary due to the compliant nature of the swage assembly 400. Further, the compliancy of the swage assembly 400 may be controlled by the selection of the resilient member 415. Additionally, in a similar manner as set forth herein, the resilient member 415 may plastically deform if subjected to a stress beyond a threshold value. In one embodiment, a fiber material 420 is disposed between the resilient member 415 and the cone segments 410. The fiber material 420 is configured to restrict the flow (or movement) of the resilient member 415 into the gap 425 as the swage assembly 400 moves between the different sizes.

Figure 12:
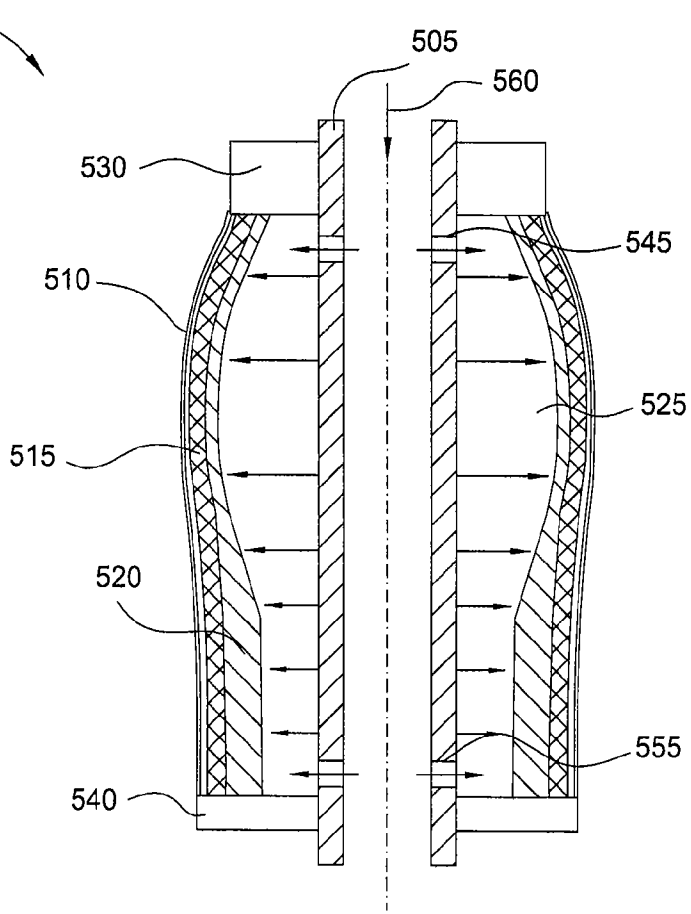
FIG. 12 is a view illustrating the swage assembly of FIG. 11 in an expanded position.
Figure 11:
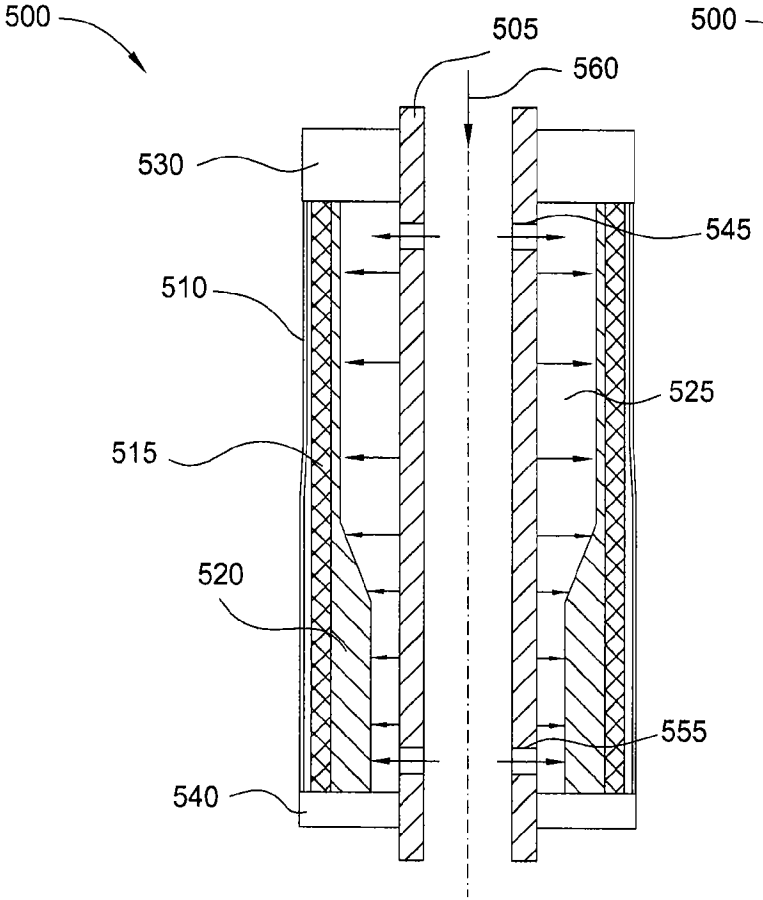
FIG. 11 is a view illustrating a swage assembly according to one embodiment of the invention, wherein the swage assembly is in a collapsed position.

FIG. 11 and FIG. 12 are views of a swage assembly 500 according to one embodiment of the invention. The swage assembly 500 is configured to expand a tubular in the wellbore. The swage assembly 500 generally includes a composite layer 515 disposed between an outer shroud 510 and an inner resilient member 520. The shroud 510 is configured to protect the composite layer 515 from abrasion as the swage assembly 500 moves through the tubular. Further, the swage assembly 500 is configured to move between a collapsed position (FIG. 11) and an expanded position (FIG. 12).

As illustrated in FIG. 11, the shroud 510, the composite layer 515 and the resilient member 520 are disposed around the mandrel 505. Each end of the composite layer 515 is attached to the mandrel 505 via a first support 530 and a second support 540. As also shown in FIG. 11, the swage assembly 500 includes a fluid chamber 525 that is defined between the resilient member 520, the mandrel 505, the first support 530 and the second support 540. Additionally, the composite layer 515 may be made from any type of composite material, such as Zylon® and/or Kevlar®.

The swage assembly 500 moves between the collapsed position, and the expanded position as fluid, represented by arrow 560, is pumped through the mandrel 505 and into the chamber 525 via ports 545, 555. As fluid pressure builds in the chamber 525, the fluid pressure causes the composite layer 515 to move radially outward relative to the mandrel 505 to the expanded position. As the swage assembly 500 is urged through the tubular, the swage assembly 500 compliantly expands the tubular. The force acting on the inner diameter of the tubular may vary due to the compliant nature of the swage assembly 500. Further, the compliancy of the swage assembly 500 may be controlled by metering fluid out of the chamber 525. For instance, as the swage assembly 500 contacts the inner diameter of the tubular proximate a restriction, the swage assembly 500 may contract from the expanded position (or move radially inward) and then return to the expanded position (or move radially outward) as the swage assembly 500 continues to move through the tubular past the restriction. The contraction of the swage assembly 500 causes the internal fluid pressure in the chamber 525 to increase. This increase in fluid pressure may be released by a multi-set rupture disk (not shown) or another metering device. In the embodiment shown in FIG. 12, the swage assembly 500 is configured as a fixed angle swage. In another embodiment, the swage assembly 500 may be configured as a variable angle swage.

Figure 14:
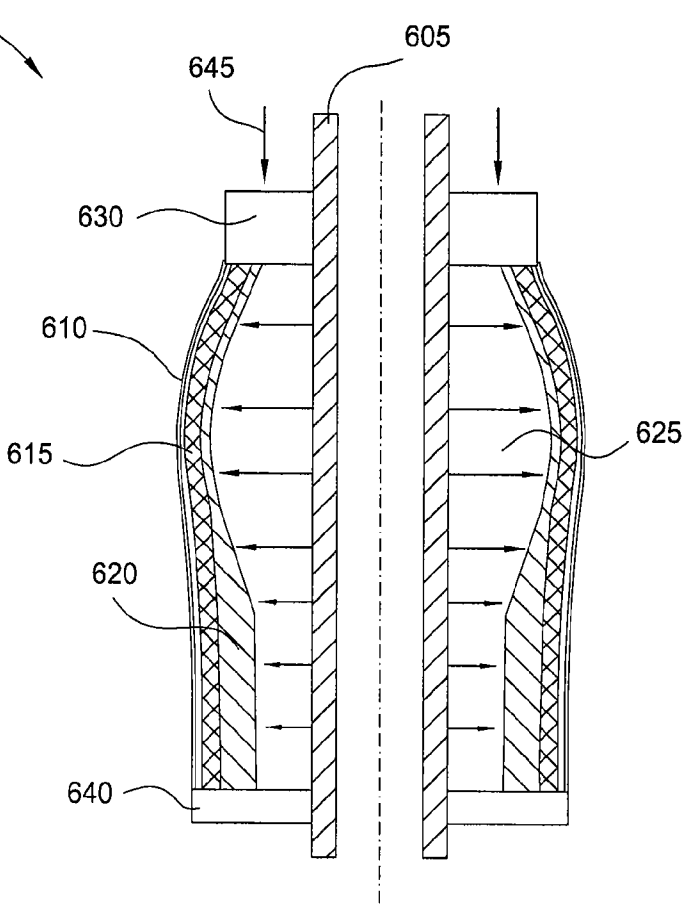
FIG. 14 is a view illustrating the swage assembly of FIG. 13 in an expanded position.
Figure 13:
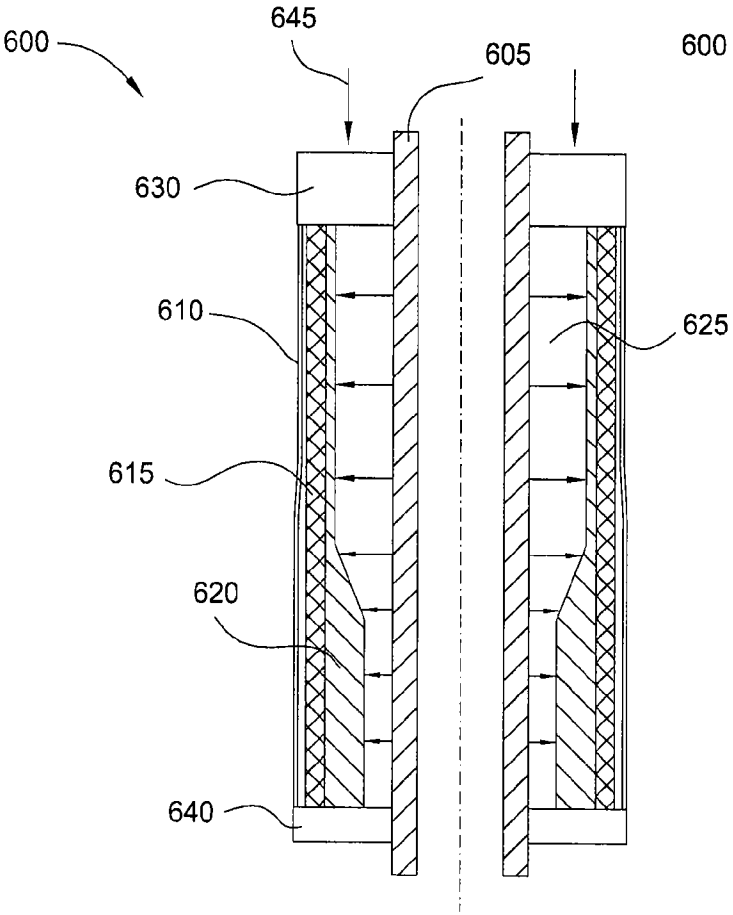
FIG. 13 is a view illustrating a swage assembly according to one embodiment of the invention, wherein the swage assembly is in a collapsed position.

FIG. 13 and FIG. 14 are views of a swage assembly 600 according to one embodiment of the invention. The swage assembly 600 generally includes a composite layer 615 disposed between an outer shroud 610 and an inner resilient member 620. The swage assembly 600 is configured to move between a collapsed position (FIG. 13) and an expanded position (FIG. 14).

As illustrated in FIG. 13, the swage assembly 600 includes a chamber 625 that is defined between the resilient member 620, the mandrel 620, a first support 630 and a second support 640. The chamber 625 typically includes a fluid, such as a liquid and/or gas. The swage assembly 600 moves between the collapsed position and the expanded position as a force 645 acts on the first support 630. The force 645 causes the support member 630 to move axially along the mandrel 605 toward the second support 640, which is fixed to the mandrel 605. The movement of the support member 630 pressurizes the fluid in the chamber 625. As fluid pressure builds in the chamber 625, the fluid pressure causes the composite layer 615 to move radially outward relative to the mandrel 605 to the expanded position.

As the swage assembly 600 is urged through the tubular, the swage assembly 600 expands the tubular in a compliant manner. The compliancy of the swage assembly 600 may be controlled by adjusting the force 645 applied to the first support 630. In other words, as the force 645 is increased, the pressure in the chamber 625 is increased, which reduces the compliancy of the swage assembly 600. In contrast, as the force 645 is decreased, the pressure in the chamber 625 is decreased, which increases the compliancy of the swage assembly 600. This aspect may be important when the swage assembly 600 contacts an inner diameter of the tubular proximate a restriction, the swage assembly 600 may contract from the expanded position (or move radially inward) and then return to the expanded position (or move radially outward) as the swage assembly 600 moves through the tubular past the restriction. The contraction of the swage assembly 600 causes the internal fluid pressure in the chamber 625 to increase. This increase in fluid pressure may be controlled by reducing the force 645 applied to the first support 630 and allowing the first support 630 to move axially away from the second support 640. In another embodiment, the second support 640 may be configured to move relative to first support 630 in order to pressurize the chamber 625. In a further embodiment, both the first support 630 and the second support 640 may move along the mandrel 605 in order to pressurize the chamber 625.

Figure 16:
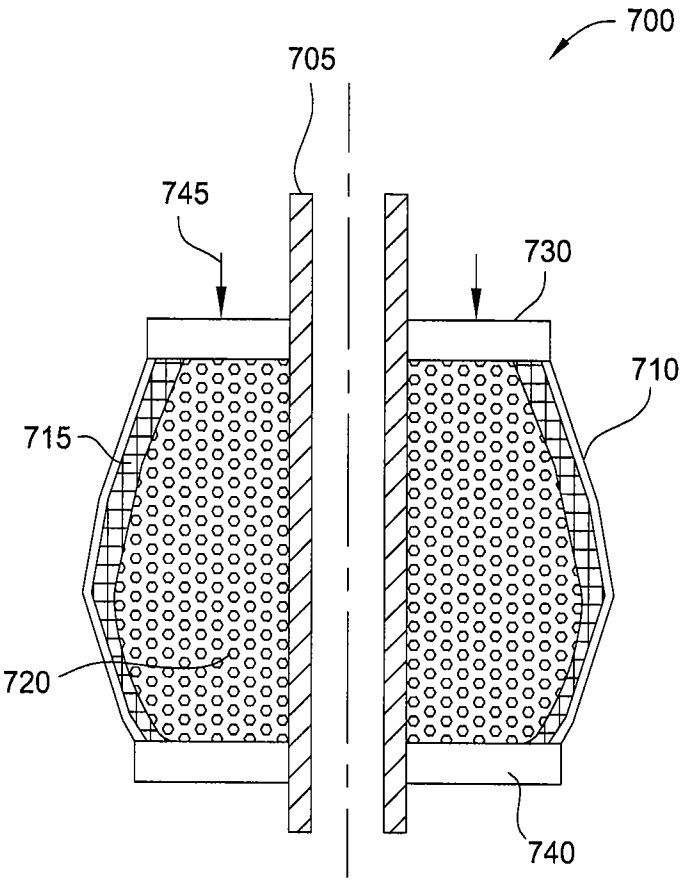
FIG. 16 is a view illustrating the swage assembly of FIG. 15 in an expanded position.
Figure 15:
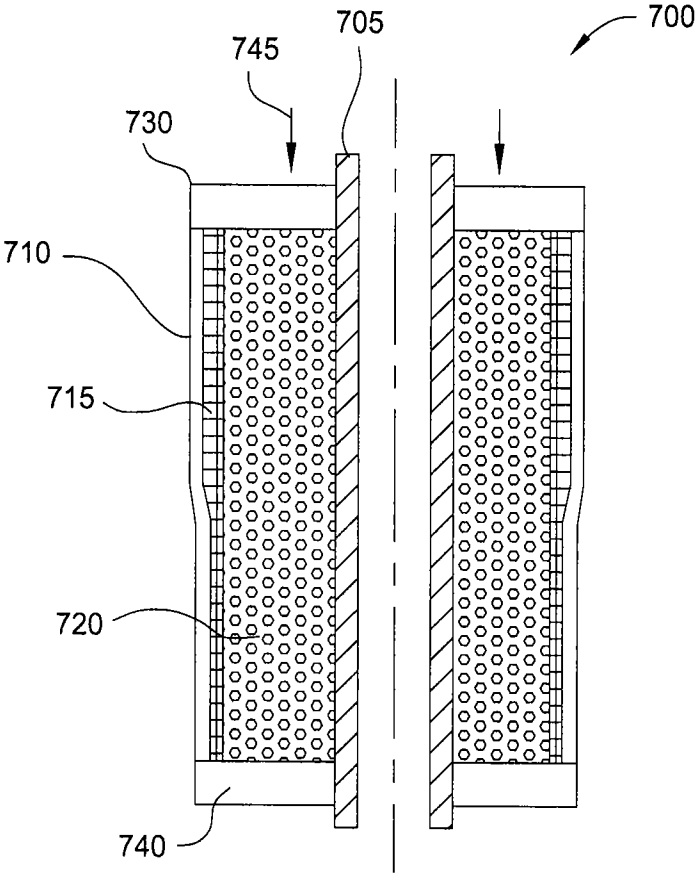
FIG. 15 is a view illustrating a swage assembly according to one embodiment of the invention, wherein the swage assembly is in a collapsed position.

FIG. 15 and FIG. 16 are views of a swage assembly 700 according to one embodiment of the invention. The swage assembly 700 generally includes a composite layer 715 disposed between an outer shroud 710 and an elastomer 720. The swage assembly 700 is configured to move between a collapsed position and an expanded position as shown in FIGS. 15 and 16, respectively.

The swage assembly 700 moves between the collapsed position and the expanded position as a force 745 acts on the first support 730. The force 745 causes the support member 730 to move axially along the mandrel 705 toward the second support 740, which is fixed to the mandrel 705. The movement of the support member 730 compresses the elastomer 720. As the elastomer 720 is compressed, the elastomer 720 is reshaped, which causes the swage assembly 700 to move radially outward relative to the mandrel 705 to the expanded position.

As the swage assembly 700 is urged through the tubular, the swage assembly 700 expands the tubular in a compliant manner. The compliancy of the swage assembly 700 may be controlled by the selection of the elastomer 720. For instance, a rigid material may be selected when the expansion application requires a small range compliancy, or a flexible material may be selected when the expansion application requires a wider range of compliancy. The amount of expansion of the swage assembly 700 may be controlled by adjusting the force 745 applied to the first support 730. In other words, as the force 745 is increased, the pressure on the elastomer 720 is increased, which causes the composite layer 715 to expand radially outward relative to the mandrel 705. In contrast, as the force 745 is decreased, the pressure on the elastomer 720 is decreased, which causes the composite layer 715 to contract radially inward. This aspect may be important when the swage assembly 700 contacts the inner diameter of the tubular proximate a restriction. In this situation, the swage assembly 700 may contract from the expanded position (or move radially inward) and then return to the expanded position (or move radially outward) as the swage assembly 700 moves through the tubular past the restriction. The contraction of the swage assembly 700 causes the elastomer 720 to be reshaped. In another embodiment, the second support 740 may be configured to move relative to first support 730 in order to reshape the swage assembly 700. In a further embodiment, both the first support 730 and the second support 740 may move along the mandrel 705 in order to reshape the swage assembly 700.

Figure 17B:
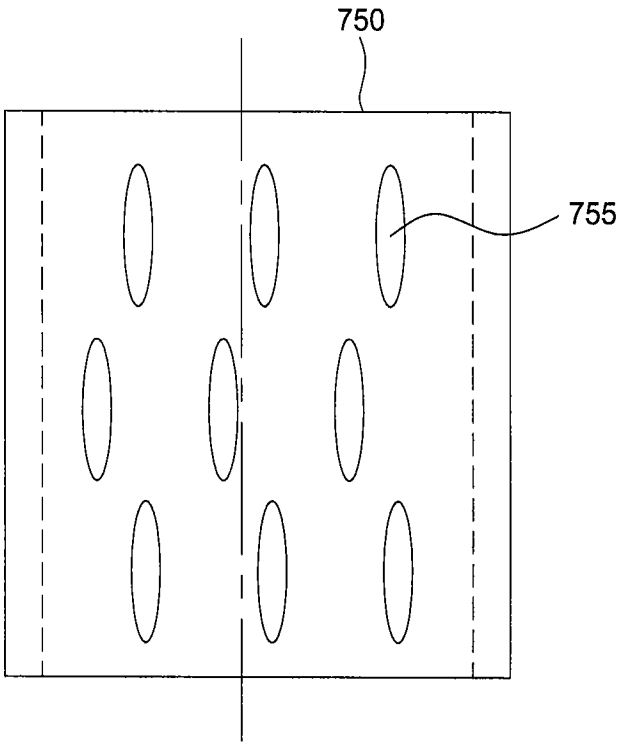
FIGS. 17A and 17B are views illustrating a shroud for use with a swage assembly.
Figure 17A:
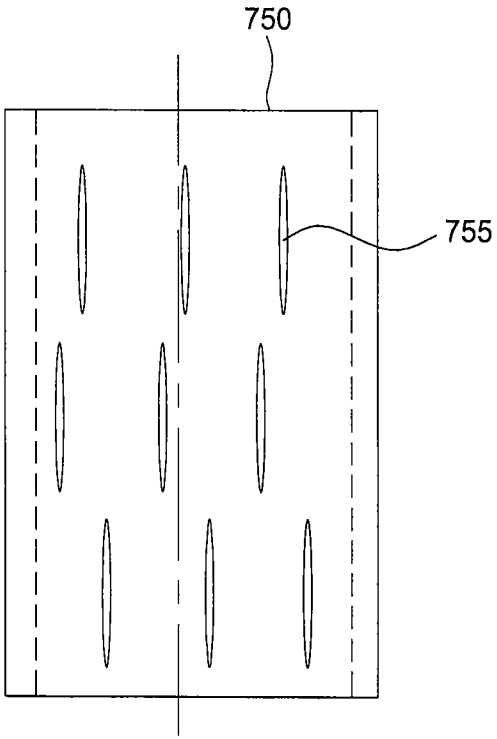

FIGS. 17A and 17B are views illustrating a shroud 750 for use with the swage assembly 500, 600 or 700. Generally, the shroud 750 is configured to protect the composite layer from abrasion as the swage assembly moves through the tubular. In the embodiment shown, the shroud 750 includes a plurality of openings 755 that allows the shroud 750 to expand (FIG. 17B) or contract (FIG. 17A) as the swage assembly expands or contracts.

Figure 18:
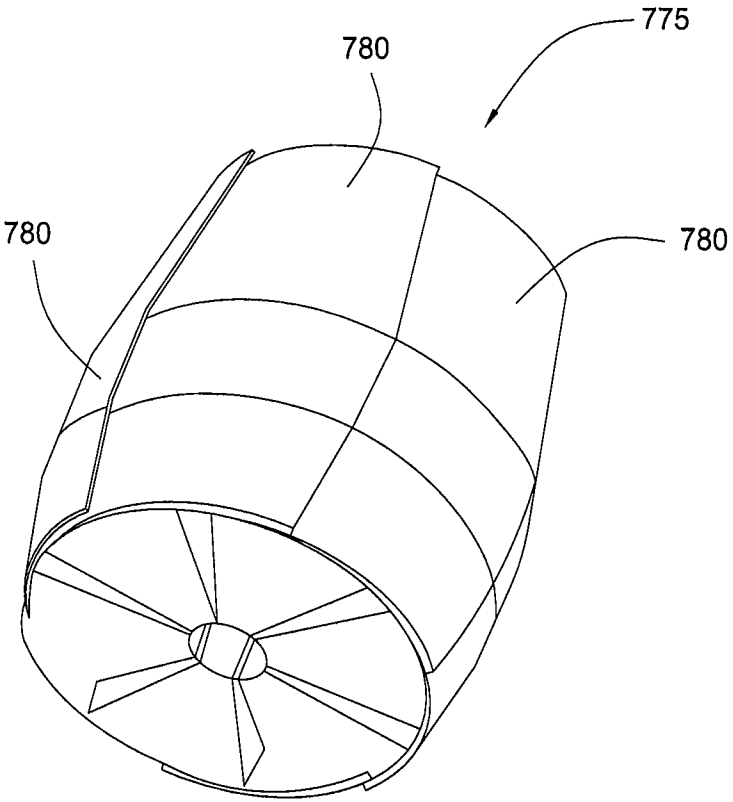
FIG. 18 is a view illustrating a shroud for use with a swage assembly.

FIG. 18 is a view illustrating a shroud 775 for use with the swage assembly 500, 600 or 700. The shroud 775 is configured to protect the composite layer from abrasion as the swage assembly moves through the tubular. The shroud 775 includes a plurality of overlapping slats 780. As the swage assembly expands or contracts, the overlapping slats 780 move relative to each other.

For some embodiments, the swage assembly 100, 200, 300, 400, 500, 600 or 700 may be oriented or flipped upside down such that expansion occurs in a bottom-top direction. In operation, a pull force, instead of the push force, is applied to the swage assembly to move the swage assembly through the tubular that is to be expanded. The cone portion can still flex upon encountering a restriction as described herein.

Figure 19:
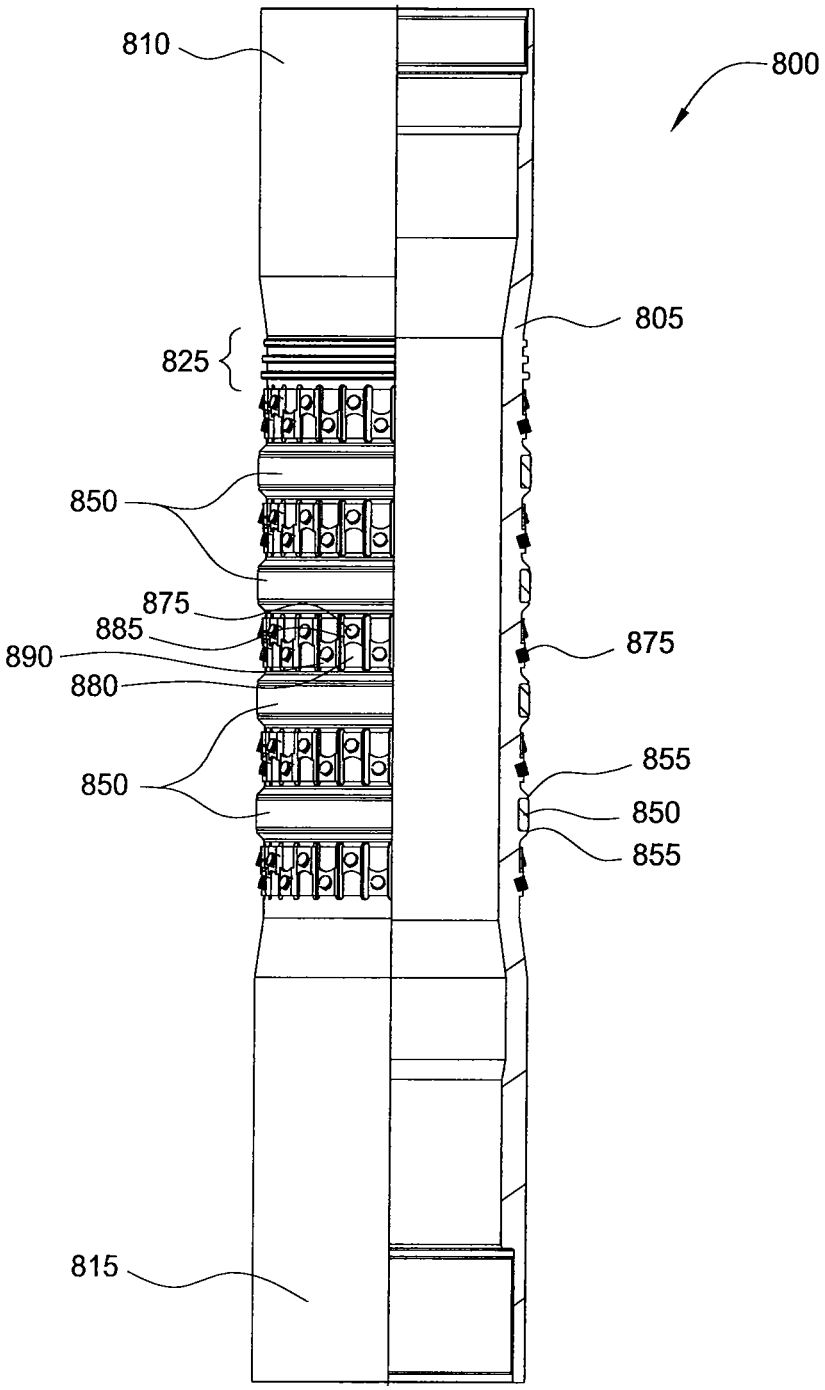
FIG. 19 is a partial section view of an expandable liner hanger according to one embodiment of the invention.

FIG. 19 is a view of an expandable liner hanger 800 according to one embodiment of the invention. Generally, the hanger 800 is used to support a string of liner in a surrounding casing (not shown). The hanger 800 includes a body 805 with an upper connection member 810 and a lower connection member 815, which may be used to connect the hanger 800 to other wellbore components, such as a workstring and/or a string of liner.

The hanger 800 includes one or more setting rings 825 disposed around its body 805. The setting rings 825 may be used during the expansion operation to reshape a swage assembly. As illustrated in FIG. 19, the setting rings 825 comprise three rings of increasing height relative to the body 805. This arrangement allows the setting rings 825 to gradually reshape the swage assembly as the hanger 800 is expanded. It is to be noted that the swage assembly is reshaped when the casing includes an inner diameter on the low side of the API tolerances (i.e., small inner diameter). It is to be further noted that if the casing has an inner diameter, which is on the high side of the API tolerances (i.e., large inner diameter), then the setting rings 825 do not reshape the swage assembly to the same extent. In one embodiment, one or more of the setting rings 825 do not contact the casing when the casing inner diameter is on the high side of the API tolerances. The process relating to the selection of the setting rings 825 is described in FIG. 20. Although FIG. 19 shows three setting rings 825, any number of setting rings such as one, two or four, may be disposed around the body 805 without departing from principles of the present invention. Additionally, the setting rings 825 may be configured in any geometric shape, such as a square shape, a round shape, a trapezoidal shape, a wedge shape profile, etc. The setting rings 825 may also be continuous, non-continuous or substantially continuous around the circumference of the casing. Further, the setting rings could be a spiral of the same or increasing thickness. Furthermore, the setting rings 825 may have the same height, or the setting rings 825 may be staggered at different heights relative to the body 805 of the hanger 800. It should be noted that the setting rings are configured as a wall thickness-increasing structure. The wall thickness-increasing structure may be a ring member (as illustrated), a boss or any other type of structure that could cause the swage assembly to move between a first configuration and a second configuration as set forth herein.

The hanger 800 further includes a plurality of gripping inserts 875. In the embodiment shown, each insert 875 is mounted on a base 890 having an aperture formed therein. As illustrated, each insert 875 is mounted in the base 890 at an angle. It should be noted that other embodiments are contemplated. For instance, in one embodiment, some of the inserts 875 may be configured at one angle and other inserts 875 at another angle relative to the base 890. Additionally, some of the inserts 875 may not be mounted at an angle relative to the base 890. The inserts 875 are used to grip the casing upon expansion of the hanger 800 and are typically made of a tough and hard material like tungsten carbide. Further, the inserts 875 may have any number of shapes without departing from the principles of the present invention. The inserts 875 are staggered in an axial direction and offset in an angular array for loading efficiency, but other configurations are also contemplated.

In the embodiment illustrated, the inserts 875 are separated by stress-relieving zones 885. The stress-relieving zones 885 may be configured as a recess in any shape, such as grooves (as illustrated) or circles. The stress-relieving zones 885 are configured to promote positive gripping penetration of the inserts 875 into the casing. The stress-relieving zones 885 are also used to mitigate movement of the inserts 875 in the base 890 and its aperture during expansion of the hanger 800. The movement of the inserts 875 may cause the inserts 875 to become loose and eventually fall out of the base 890, which would release the grip between the hanger 800 and the casing. Further, the stress-relieving zones 885 are used to mitigate deformation of the base 890 during expansion of the hanger 800. In another embodiment, the inserts 875 and the stress-relieving zones 885 are configured in a spiral pattern around the body 805, rather than a set uniform pattern as illustrated. This arrangement may reduce expansion forces required to expand the hanger 800. It should be noted in a small ID tolerance casing (or a heavier weight casing), the insert 875 penetration gets limited once significant insert area is pressed against the casing. This may cause the inserts 875 to move slightly, thereby causing some metal underneath the inserts 875 to move. Some of this metal mass underneath the inserts 875 may be dislocated into the stress-relieving zones 885 which then act as a metal sump, and this allowed movement keeps the expansion forces low and minimizes deformable cone setting. Adjacent each insert 875 is an expansion-relief zone 880 that is configured to reduce expansion forces required to be applied to the swage assembly.

The hanger 800 includes one or more seal members 850 disposed around the body 805. The seal members 850 are configured to create a seal with an inner diameter of the surrounding casing. In order to create an effective seal, the expansion pressure applied to the seal members 850 should generate a predetermined seal compression, whether the inner diameter of the casing is on the low side or the high side of the API tolerances. If the seal members 850 are over compressed (or stressed), then the seal members 850 will fail to maintain a seal which may damage the hanger 800. Alternatively, if the seal members 850 are under compressed, then the seal members 850 may not create a sealing relationship with the surrounding casing. To control the expansion pressure applied to the seal members 850, the setting rings 825 and the outer diameter of the swage assembly are selected based upon the API tolerances of the surrounding casing (see FIG. 20).

The seal members 850 may be attached to the body 805 by any means known in the art, such as bonding, glue, etc. The seal members 850 may be fabricated from elastomeric material, composite material, metal or any other type of sealing material. As shown in FIG. 19, the seal members 850 and the inserts 875 are staggered to create sealing and slip zones across a length of the body 805. Upon expansion of the hanger 800, this arrangement allows the seal members 850 to isolate and protect groups of inserts 875 from wellbore pressure in an annulus formed between the hanger 800 and the casing, which otherwise could cause the inserts 875 to disengage from the casing and release the grip arrangement between the hanger 800 and the casing. The wellbore pressure could come from a direction below the hanger 800 and/or a direction above the hanger 800. In either case, the inserts 875 between the seal members 850 are protected.

A ring member 855 may be positioned on each side of the seal member 850 to hold the seal member 850 in place on the body 805 during the run-in of the hanger 800 to prevent washout due to fluid by-pass. Upon expansion of the hanger 800, the ring members 855 are configured to contain the seal members 850. It is to be noted that when the swage assembly passes the seal member 850, a portion of the seal member 850 may be displaced over and beyond the ring member 855. Upon exposure to hydraulic pressure the seal member then tends to retract back against the ring member 855, constrained between the hanger outer diameter and the casing inner diameter, thus increasing pressure resistance. In one embodiment, the ring member 855 may be configured to contact the casing and create a seal upon expansion of the hanger 800. The seal between the ring member 855 and the casing may be a metal-to-metal seal.

Figure 20:
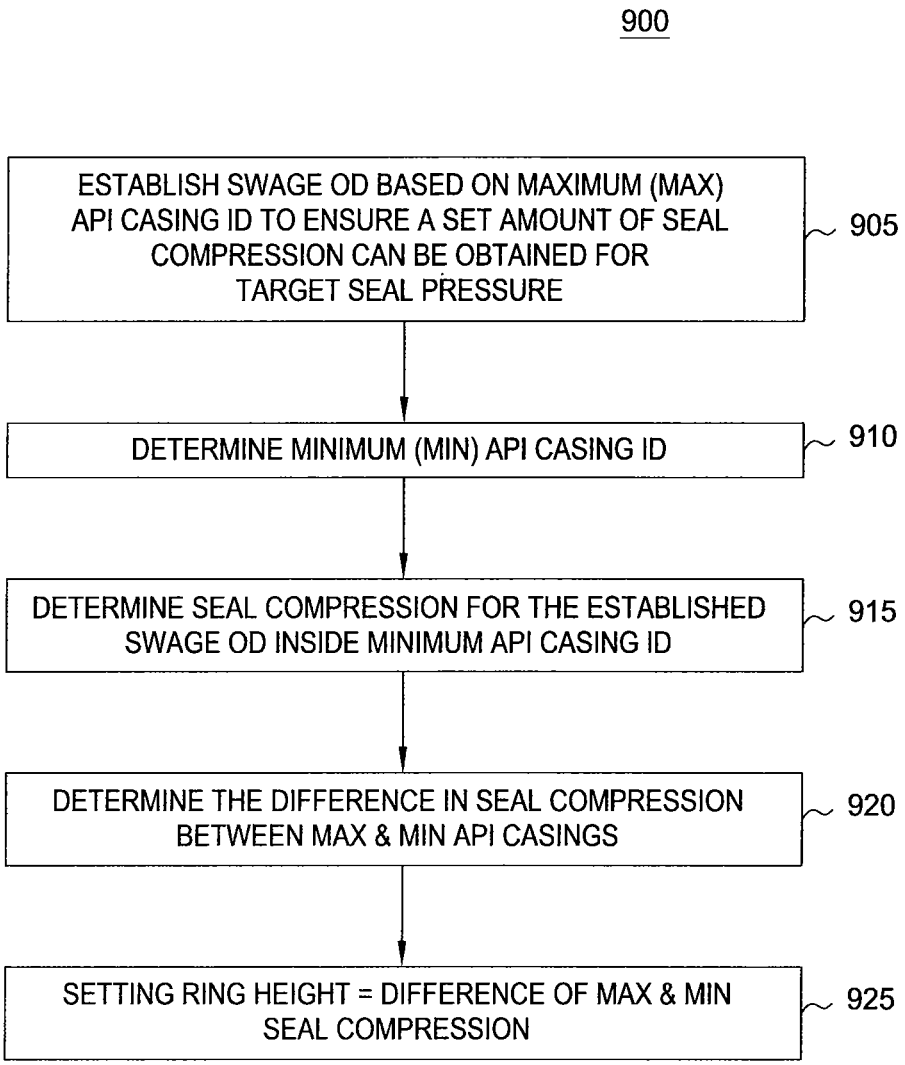
FIG. 20 is a flow chart of method steps for selection of setting rings according to one embodiment of the invention.

FIG. 20 is a flow chart of steps 900 for the sizing of a swage assembly and for the selection of setting rings. The steps 900 are based upon the API tolerances of the casing. In step 905, the initial outer diameter of a solid deformable cone 955 of a swage assembly 950 (see FIG. 21) is selected based upon the maximum API inner diameter for the casing. Step 905 is carried out in order to ensure a set amount of seal member compression is obtained. It should be noted that sufficient insert gripping penetration has also been taken into account in step 905. In step 910, the minimum API inner diameter for the casing is determined from an API chart for the specific casing size.

In step 915, the seal member compression is determined based upon the established outer diameter of the swage assembly and minimum API inner diameter for the casing. In step 920, the difference in the seal member compression between the maximum API inner diameter and the minimum API inner diameter for the casing is determined. In one embodiment, the determination is accomplished by measuring the thickness of the seal member when the seal member is compressed in the casing having a minimum API inner diameter, and measuring the thickness of the seal member when the seal member is compressed in the casing having a maximum API inner diameter. In step 925, the height of the setting ring relative to the outer surface of the body 805 is set based upon the difference between the maximum and minimum seal member compression. As set forth herein, the inner diameter of the casing is typically based upon predetermined API tolerances, however, in one embodiment, the inner diameter of the casing could be measured by using a caliper tool. The actual inner diameter could then be compared to the predetermined API tolerances of the casing in order to verify that the actual inner diameter is between the maximum API inner diameter and the minimum API inner diameter for the casing.

The setting ring may be molded or machined on the body 805. The setting ring may also be a separate component that is attached to the body 805 during the manufacture of the tubular (or liner hanger) or attached to the body after manufacture, (e.g., at the wellsite) by any means known in the art, such as bonding, glue, welding, etc. The ability to attach the setting ring at the wellsite allows the flexibility of selecting the setting ring based upon the actual inner diameter of the casing. More specifically, the inner diameter of the casing may be measured by using a caliper. The measured inner diameter may be then used to select the appropriate configuration of the setting ring, such as height, width, etc., and a suitable setting ring may be selected. The selected setting ring may be attached to the tubular (or liner hanger) and the assembly subsequently run into the casing and expanded as set forth herein.

Figure 21:
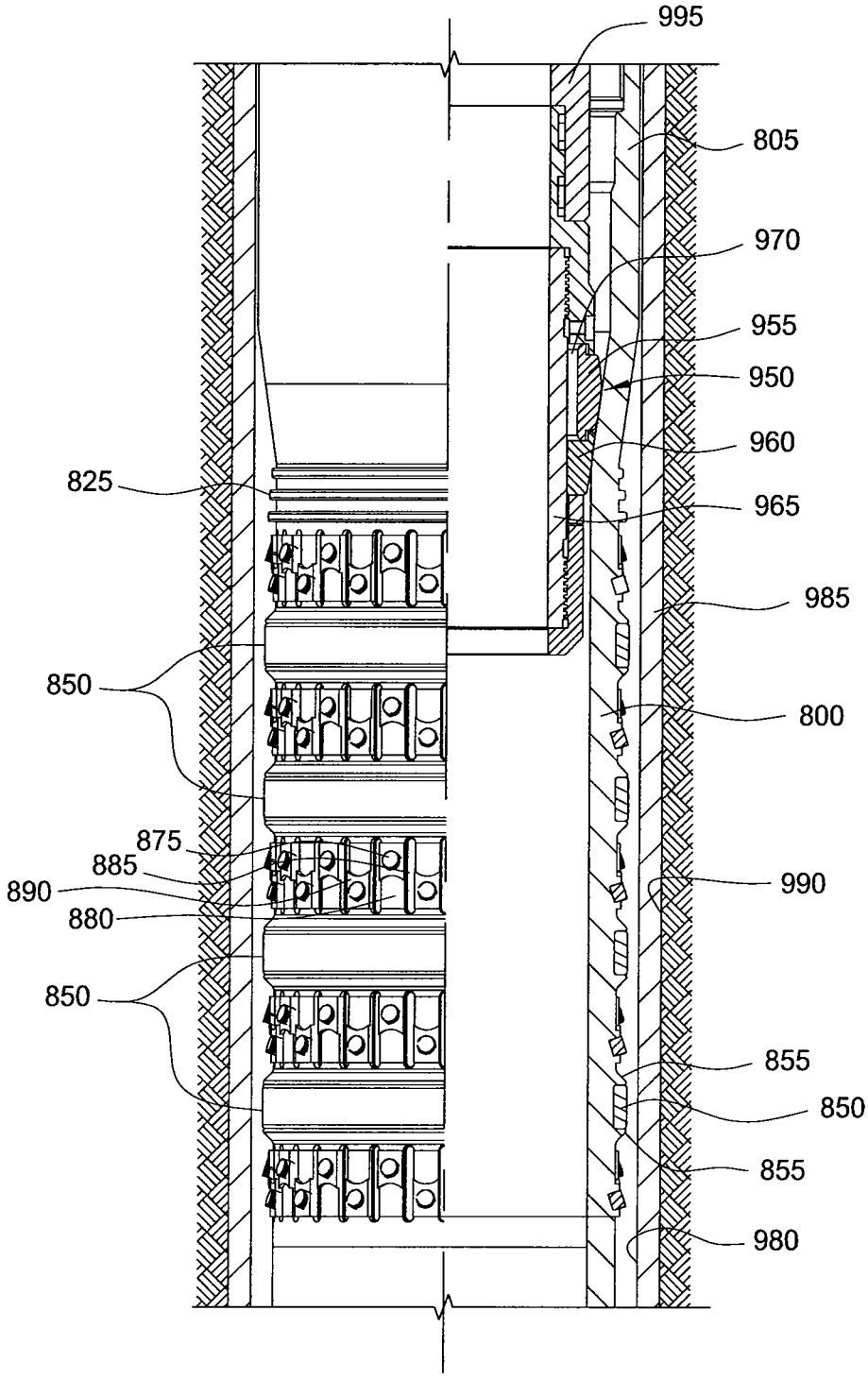
FIG. 21 is a view of a swage assembly expanding an upper portion of the expandable liner hanger into a casing.

FIG. 21 is a view of a swage assembly 950 expanding the expandable liner hanger 800. In the present specification, the terms "expander," "expander tool" and "swage" are used interchangeably unless otherwise stated. It is to be noted that the expandable liner hanger 800 may be used with any expansion tool whose dimension can be varied (e.g., swage with movable segments or fingers) without departing from the principles of the present invention. As shown, the hanger 800 is disposed in a casing 985, which lines the wellbore 990. In some embodiments, cement may be disposed in between the wellbore 990 and the casing 985. Further, the hanger 800 may be positioned in the wellbore 990 by a running tool as set forth herein. In one embodiment, the hanger 800 and the swage assembly 950 are positioned in the wellbore 990 at the same time. In another embodiment, the hanger 800 and the swage assembly 950 are positioned in the wellbore 990 separately.

The swage assembly 950 includes a substantially solid deformable cone 955. The swage assembly 950 may be moved from a first, larger diameter configuration where the swage assembly 950 has a substantially compliant manner to a second, smaller diameter configuration where the swage assembly 950 has a substantially non-compliant manner. The solid deformable cone 955 is disposed in a cavity 970 formed in a body 965. The cross-section of the solid deformable cone 955 is configured to allow the solid deformable cone 955 to move within the cavity 970. For instance, when the swage assembly 950 is in the first configuration, the solid deformable cone 955 is generally movable within the cavity 970 as the swage assembly 950 is urged through the hanger 800. When the swage assembly 950 is in the second configuration, the solid deformable cone 955 generally remains substantially stationary within the cavity 970 as the swage assembly 950 is urged through the hanger 800. The position of the solid deformable cone 955 in the cavity 970 relates to the shape of the swage assembly 950. Additionally, after the swage assembly 950 is removed from the wellbore 990, the solid deformable cone 955 may be removed and replaced with another solid deformable cone 955, if necessary. It is to be noted that the swage assembly illustrated is an example of one swage assembly. Other types of swage assemblies that are moveable between a first configuration and a second configuration may be used without departing from the principles of the present invention. In another embodiment, the size of the solid deformable cone 955 may be selected based upon the inner diameter 980 of the casing 985. In this embodiment, the inner diameter 980 of the casing 985 may be measured by a caliper tool. The measured inner diameter is then used to select the appropriate size of the solid deformable cone 955. The selection of the solid deformable cone size may be based upon the measured inner diameter and its variation along the zone where the expandable tubular (or liner hanger) is to be expanded. The selection of the solid deformable cone size may also be based upon the dimensions of the seal members 850 and/or the dimensions of the setting rings 825 (e.g., restrictions) on the expandable tubular (or liner hanger). Further, the selection of the solid deformable cone size may be based upon the desired pressure rating of the seal to be made using the expandable tubular. The selection of the size of the solid deformable cone 955 is particularly important if the measured inner diameter is outside the maximum and the minimum API inner diameters and/or if the casing 985 exhibits an irregular cross-sectional shape, such as an oval shape.

The swage assembly 950 may include an optional non-deformable cone 960. Generally, the non-deformable cone 960 is the portion of the swage assembly 950 that initially contacts and expands the hanger 800 as the swage assembly 950 is urged through the hanger 800 via a workstring 995. The non-deformable cone 960 is typically made from a material that has a higher yield strength than a material of the solid deformable cone 955. For instance, the non-deformable cone 960 may be made from a material having 150 ksi, while the solid deformable cone 955 may be made from a material having 135 ksi. The difference in the yield strength of the material between the non-deformable cone 960 and the solid deformable cone 955 allows the solid deformable cone 955 to collapse inward as a certain radial force is applied to the swage assembly 950. The selection of the material for the solid deformable cone 955 relates to the amount of compliancy in the swage assembly 950. Further, the material may be selected depending on the expansion application. For instance, a material with a high yield strength may be selected when the expansion application requires a small range compliancy or a material with a low yield strength may be selected when the expansion application requires a wider range of compliancy. In a further embodiment, the non-deformable cone 960 and the solid deformable cone 955 may be made from a similar material with varying cross-sections. In this embodiment, the non-deformable cone 960 would have a considerably thicker cross-section (or sectional collapse resistance) as compared to the cross-section of the solid deformable cone 955. The difference in the thickness of the cross-section allows the solid deformable cone 955 to collapse inward as a certain radial force is applied to the swage assembly 950. The selection of the thickness for the solid deformable cone 955 directly relates to the amount of compliancy in the swage assembly 950. The amount of compliancy allows the swage assembly 950 to compensate for variations in the internal diameter of the casing 985.

As illustrated in FIG. 21, the swage assembly 950 is expanding an upper portion of the hanger 800 into contact with the casing 985. It is to be noted that the swage assembly 950 is in the first configuration such that the solid deformable cone 955 is movable within the cavity 970 as the swage assembly 950 is urged through the hanger 800.

Figure 22:
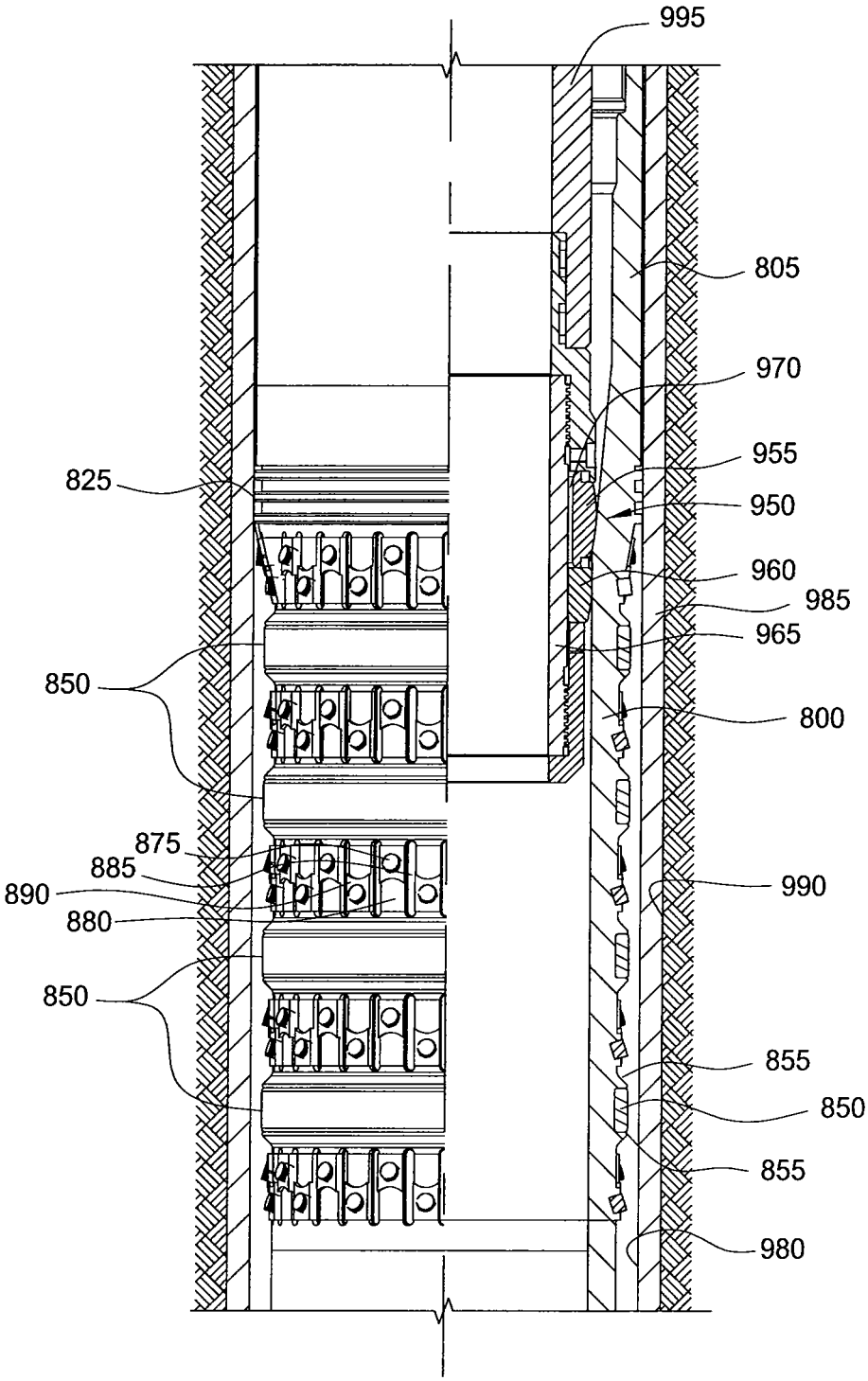
FIG. 22 is a view of the swage assembly expanding setting rings on the expandable liner hanger.
Figure 23:
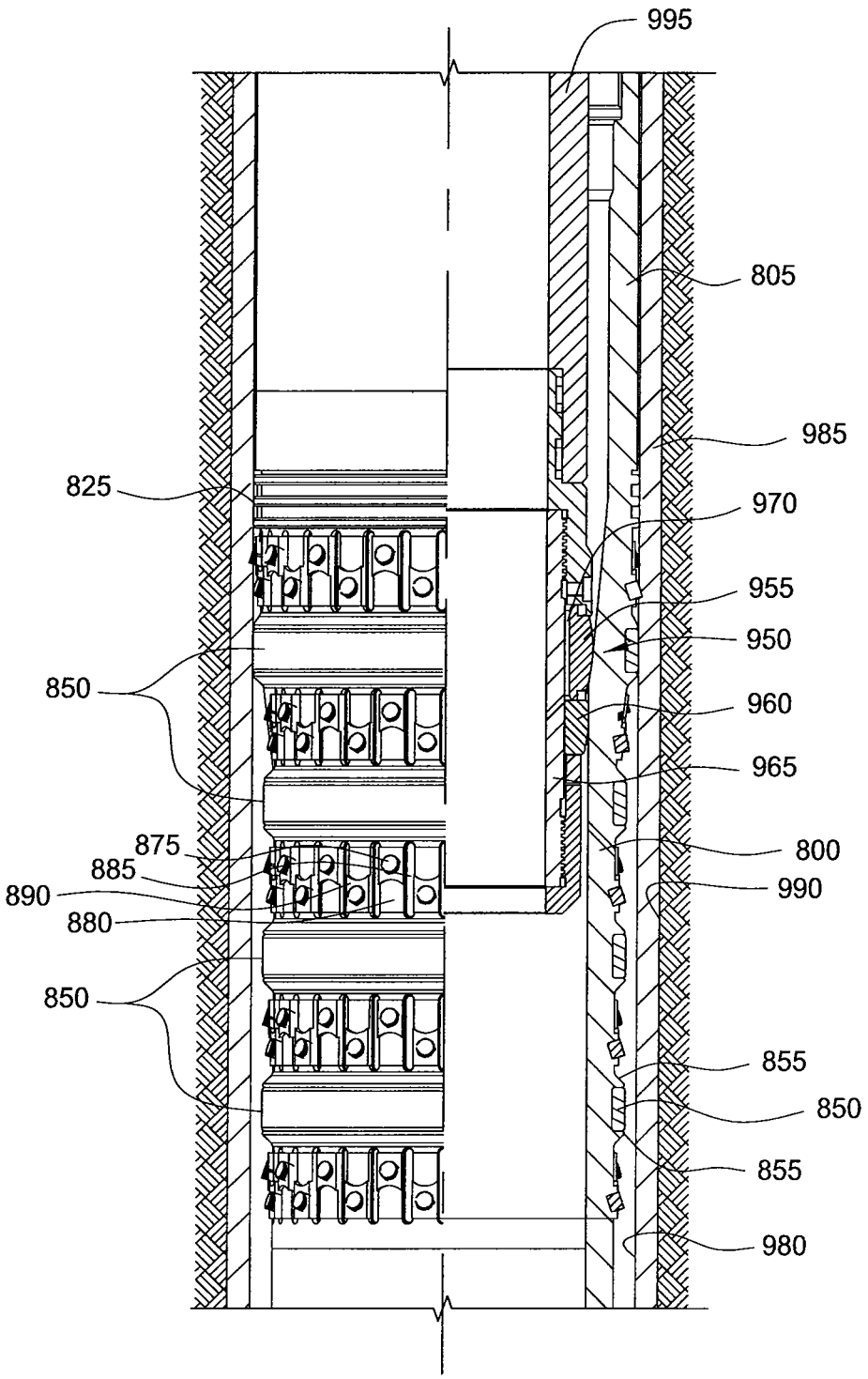
FIG. 23 is a view illustrating the swage assembly expanding another portion of the expandable liner hanger.

FIG. 22 is a view of the swage assembly 950 expanding setting rings 825 on the expandable liner hanger 800. The setting rings 825 may be used during the expansion operation to reshape the swage assembly 950 to its second configuration in order to promote uniform expansion pressure on the seal members 850. It is to be noted that the setting rings 825 reshape the swage assembly 950 when an inner diameter 980 of the casing 985 is on the low side of the API tolerances (i.e., small inner diameter) as illustrated in FIGS. 21-23. It should be further noted that if the inner diameter 980 of the casing 985 is on the high side of the API tolerances (i.e., large inner diameter), then the setting rings 825 do not reshape the swage assembly 950 to the same extent and may not reshape the swage assembly 950 at all. As set forth herein, the outer diameter of the swage assembly 950 has been selected to operate in the casing 985 having a maximum API inner diameter (see FIG. 20). It is also to be noted that aspects of the present invention can span different casing weights not only that of the API tolerances of individual weights.

In the embodiment illustrated, the setting rings 825 are disposed on the body 805 such that the swage assembly 950 expands the setting rings 825 before it expands the plurality of inserts 875 and the seal members 850. The size, material and height of setting rings 825 are designed to change the configuration of the swage assembly 950 if necessary. For example, if the inner diameter 980 of the casing 985 is on the low side of the API tolerances (i.e., small inner diameter), then the expansion of the setting rings 825, when they are placed into contact with the casing 985, will cause the swage assembly 950 to move from the first configuration to the second configuration. The change in configuration of the swage assembly 950 occurs when the force required to expand the setting rings 825 is greater than the force required to urge the material of deformable cone 955 past its yield point such that the material of the deformable cone 955 will plastically deform and the swage assembly 950 will move from the first configuration to the second configuration. As set forth herein, in the second configuration, the solid deformable cone 955 generally remains substantially stationary within the cavity 970 during the expansion operation. It is to be noted that the number of setting rings 825 and the staggered heights of the setting rings 825 may be configured such that the swage assembly 950 gradually moves from the first configuration to the second configuration. In the embodiment illustrated in FIG. 22, the swage assembly 950 has moved from the first configuration (FIG. 21) to the second configuration.

It is also to be noted that if the casing has an irregular cross-sectional shape, such as an oval shape, then the swage assembly 950 will conform to the irregular shape upon expansion of the setting rings 825 as set forth herein. For instance, if the casing has an irregular cross-sectional shape with a shorter inner diameter portion and a longer inner diameter portion, then the setting rings 825 will contact the shorter inner diameter portion before contacting the longer inner diameter portion (if at all), which will cause the portion of the swage assembly 950 adjacent the shorter inner diameter to deform (or move to the second configuration). As such, the swage assembly 950 may conform to the shape of the irregular shape of the casing.

Figure 24:
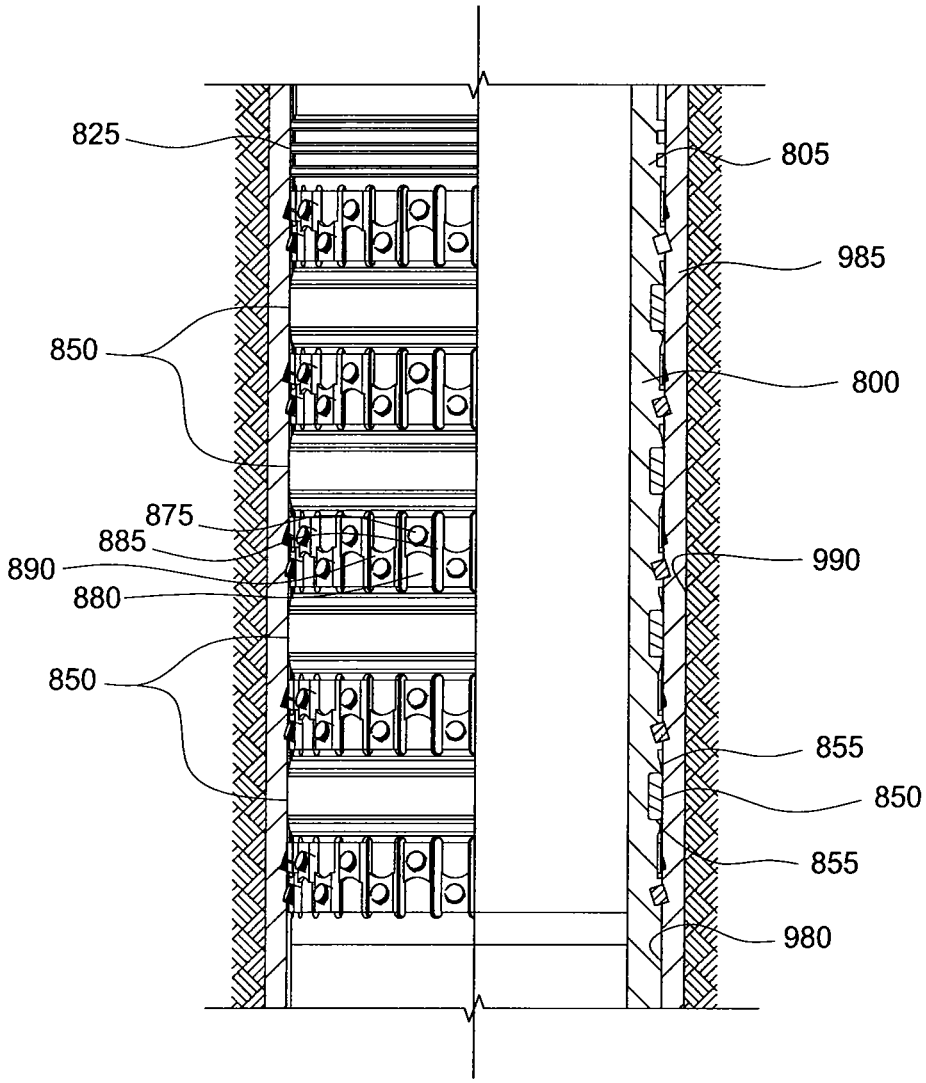
FIG. 24 is a view illustrating the expandable liner hanger expanded in the casing.

FIG. 23 is a view illustrating the swage assembly 950 expanding another portion of the expandable liner hanger 800. After the swage assembly 950 has expanded the setting rings 825, the swage assembly 950 further expands the hanger 800. As illustrated in FIG. 23, the swage assembly 950 is in the second configuration, and therefore the rest of the hanger 800 will be expanded with the swage assembly 950 in the second configuration. FIG. 24 is a view of the expandable liner hanger 800 expanded in the casing 985. As illustrated, each seal member 850 is in contact with the casing, thereby creating a sealing relationship between the hanger 800 and the casing 985.

Figure 25:
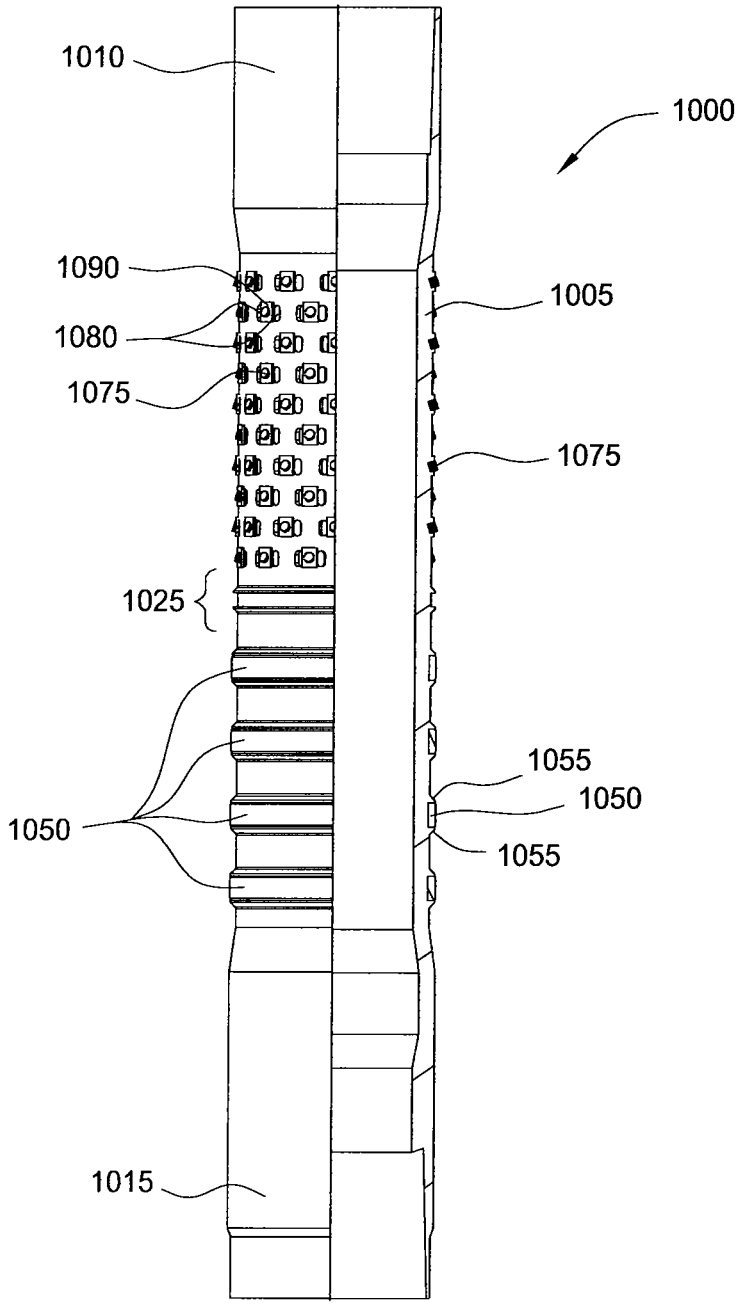
FIG. 25 is a view illustrating an expandable liner hanger according to one embodiment of the invention.

FIG. 25 is a view illustrating an expandable liner hanger 1000 according to one embodiment of the invention. The hanger 1000 includes a body 1005 with an upper connection member 1010 and a lower connection member 1015, which may be used to connect the hanger 1000 to other wellbore components, such as a workstring and/or a string of liner.

The hanger 1000 includes one or more setting rings 1025 disposed around the body 1005. The setting rings 1025 may be used during the expansion operation to reshape a swage assembly. Although FIG. 25 shows two setting rings 1025, any number of setting rings may be disposed around the body 1005 without departing from principles of the present invention. Additionally, the setting rings 1025 may be configured in any geometric shape. Further, the setting rings 1025 may have the same height or different heights relative to the body 1005 of the hanger 1000. Similar to the setting rings on the hanger 800, the setting rings 1025 reshape the swage assembly when the casing includes an inner diameter on the low side of the API tolerances (i.e., small inner diameter). It is to be noted that when the casing has an inner diameter which is on the high side of the API tolerances (i.e., large inner diameter), then the setting rings 1025 do not reshape the swage assembly to the same extent and may not reshape the swage assembly at all. The selection of the setting rings 1025 is similar to the process described in FIG. 20.

The hanger 1000 further includes a plurality of inserts 1075, such as tungsten carbide inserts. Each insert 1075 is mounted on a base 1090. Generally, the inserts 1075 are used to grip the casing upon expansion of the hanger 1000. The inserts 1075 are arranged in an array for loading efficiency. It should be noted that the inserts 1075 may be positioned on the body 1005 in any manner without departing from principles of the present invention. In the embodiment illustrated, the inserts 1075 are separated by stress-relieving zones 1085 which are configured to promote positive penetration of the inserts 1075 into the casing. The stress-relieving zones 1085 may be configured as a recess in any shape. The stress-relieving zones 1085 are also used to mitigate movement of the inserts 1075 in the base 1090 during and after expansion of the hanger 1000 (see FIGS. 26A-26B). The movement of the inserts 1075 may cause the inserts 1075 to become loose and eventually fall out of the base 1090, which would release the grip between the hanger 1000 and the casing. Further, the stress-relieving zones 1085 are also used to mitigate deformation of the base 1090 during expansion of the hanger 1000.

The hanger 1000 includes one or more seal members 1050 disposed around the body 1005. As illustrated in FIG. 25, the seal members 1050 are separated from the inserts 1075 by the setting rings 1025. This arrangement allows the inserts 1075 to be fully expanded by the swage assembly prior to the reshaping of the swage assembly due the setting rings 1025. The seal members 1050 are configured to create a seal with an inner diameter of the surrounding casing. In order to create an effective seal, the expansion pressure applied to the seal members 1050 should generate a predetermined seal compression whether the inner diameter of the casing is on the low side or high side of the API tolerances. If the seal members 1050 are over compressed (or stressed), then the seal members 1050 will fail to maintain a seal, which may damage the hanger 1000. Alternatively, if the seal members 850 are under compressed, then the seal members 1050 may not create a sealing relationship with the surrounding casing. To control the expansion pressure applied to the seal members 1050, the setting rings 1025 and the outer diameter of the swage assembly are selected based upon the API tolerances of the surrounding casing (see FIG. 20).

The seal members 1050 may be attached to the body 1005 by any means known in the art, such as bonding, glue, etc. The seal members 1050 may be fabricated from elastomeric material, composite material, metal, or any other type of sealing material. As shown in FIG. 25, a ring member 1055 may be positioned on each side of the seal member 1050 to hold the seal member 1050 in place on the body 1005 during the run-in of the hanger 1000 to prevent washout due to fluid by-pass. Upon expansion of the hanger 1000, the ring members 1055 are configured to contain the seal members 1050. It is to be noted that when the swage assembly passes the seal member 1050, a portion of the seal member 1050 may be displaced over and beyond the ring member 1055. Upon exposure to hydraulic pressure the seal member then tends to retract back against the ring member 1055, constrained between the hanger outer diameter and the casing inner diameter thus increasing pressure resistance. In one embodiment, the ring members 1055 may be configured to contact the casing and create a seal upon expansion of the hanger 1000. The seal between the ring member 1055 and the casing may be a metal-to-metal seal.

Figure 26A:
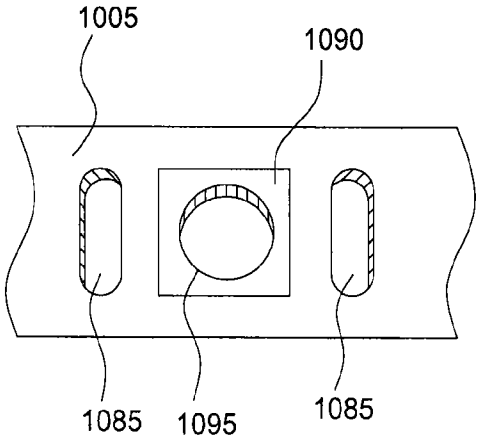
FIGS. 26A and 26B illustrate an insert base and stress-relieving zones on an expandable liner hanger.
Figure 26B:
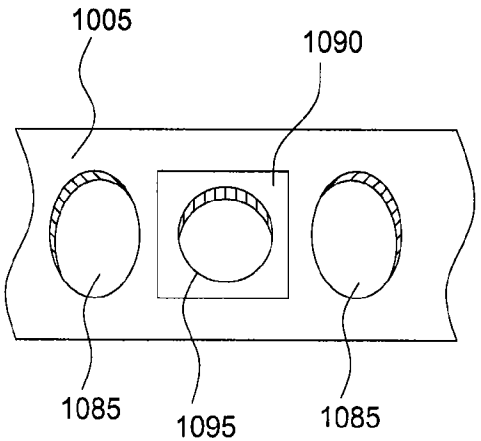

FIGS. 26A and 26B are views illustrating the base 1090 and the stress-relieving zones 1085. For clarity, the insert is not shown in the hole 1095 formed in the base 1090. FIG. 26A is a view of the base 1090 and the stress-relieving zones 1085 prior to expansion of the hanger 1000, and FIG. 26B is a view after expansion of the hanger 1000. As shown in FIGS. 26A and 26B, the base 1090 does not deform (or change shape) due to expansion of the hanger 1000 because the stress generated by expansion of the hanger 1000 proximate the base 1090 is relieved by the stress-relieving zones 1085. In comparing FIGS. 26A and 26B, the stress-relieving zones 1085 have changed shape rather than the base 1090. As a result, the insert (not shown) in the base 1090 will not move relative to the base 1090, and the integrity of the gripping portion of the hanger 1000 will be maintained. It is to be noted that the base 890 and the stress-relieving zones 885 of the hanger 800 will function in a similar manner.

Figure 27A:
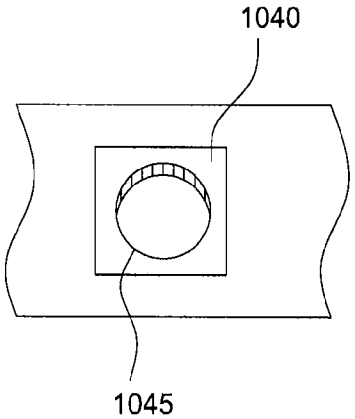
FIGS. 27A and 27B illustrate an insert base without stress-relieving zones.
Figure 27B:
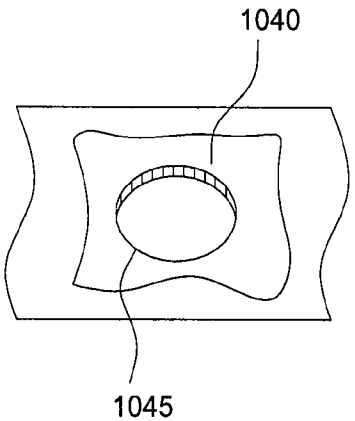

FIGS. 27A and 27B are views illustrating an insert base 1040 without stress-relieving zones. For clarity, the insert is not shown in the hole 1045 formed in the base 1040. FIG. 27A is a view of the base 1040 prior to expansion of the hanger, and FIG. 26B is a view after expansion of the hanger. As shown in FIGS. 27A and 27B, the base 1040 deforms (or changes shape) due to expansion of the hanger, because the stress generated by expansion of the hanger proximate the base 1040 is not relieved. As a result, the insert may move relative to the base 1040 and become loose, which could cause the insert to eventually fall out of the base 1040. This could cause the grip arrangement created by the inserts to fail.

While the foregoing is directed to embodiments of the present invention, other and further embodiments of the invention may be devised without departing from the basic scope thereof, and the scope thereof is determined by the claims that follow.

The invention claimed is:

1. An expandable tubular system, comprising:

an expandable tubular;

an expansion swage for expanding the expandable tubular, wherein the expansion swage is deformable from a compliant configuration to a smaller substantially non-compliant configuration; and a restriction member disposed on an exterior surface of the expandable tubular prior to expansion, wherein expansion of the expandable tubular in the location of the restriction member deforms the expansion swage from the compliant configuration to the smaller substantially non-compliant configuration.

2. The system of claim 1, further comprising a sealing member disposed on the exterior surface of the expandable tubular.

3. The system of claim 2, wherein the restriction member is disposed above the sealing member.

4. The system of claim 1, wherein the restriction member comprises a ring.

5. The system of claim 1, wherein the expandable tubular comprises a liner hanger.

6. The system of claim 5, wherein the expandable tubular further comprises a gripping element.

7. The system of claim 6, wherein the expandable tubular further includes a plurality of grooves radially disposed around the tubular, whereby the gripping element is disposed between a pair of grooves.

8. The system of claim 6, wherein the expandable tubular further includes a plurality of expansion-relief zones disposed around the tubular that are configured to reduce expansion forces required to expand the expandable tubular.

9. A liner hanger for use in a wellbore, the liner hanger comprising:

a tubular body;

a restriction member disposed on an exterior surface of the body prior to expansion;

a plurality of gripping inserts circumferentially disposed around the body, each insert housed in a corresponding aperture formed in a wall of the body; and a plurality of grooves circumferentially disposed around the body, the grooves formed parallel to a longitudinal axis of the body, whereby each insert is disposed between a pair of grooves.

10. The liner hanger of claim 9, further comprising at least one seal member disposed around the body adjacent the gripping inserts.

11. The liner hanger of claim 10, further comprising a ring member disposed adjacent each side of the seal member.

12. The liner hanger of claim 11, wherein the ring member is configured to contain the seal member within a predefined area on the body after expansion of the liner hanger.

13. The liner hanger of claim 9, wherein the restriction member includes a first setting ring and a second setting ring disposed around the body.

14. The liner hanger of claim 13, wherein an outer surface of the first setting ring is at a first distance relative to the body and an outer surface of the second setting ring is at a second larger distance relative to the body.

15. The liner hanger of claim 9, wherein each gripping insert is disposed on the body at angle relative to an outer surface of the body.

16. A method of selecting a setting ring for use with an expandable tubular having a seal member, wherein the setting ring is configured to reshape a swage assembly upon expansion of the setting ring into contact with a surrounding tubular, the method comprising:

establishing a target seal compression of the seal member upon expansion of the expandable tubular;

determining a first seal compression of the seal member based upon expanding the tubular in a surrounding tubular having a maximum inner diameter;

determining a second seal compression of the seal member based upon expanding the tubular in a surrounding tubular having a minimum inner diameter; and setting a height of the setting ring to obtain the target seal compression for the seal member based upon the first seal compression and second seal compression, wherein the height of the setting ring is different than a height of another setting ring disposed on the expandable tubular.

17. The method of claim 16, further comprising establishing an outer diameter of the swage assembly based upon expanding the tubular in the surrounding tubular having the maximum inner diameter.

18. The method of claim 16, further comprising expanding the setting ring into contact with the surrounding tubular to reshape the swage assembly, wherein the setting ring controls the amount of compression of the seal member by causing the swage assembly to change shape.

* * * * *